US006005356A

United States Patent [19]

Horiuchi et al.

[11] Patent Number: 6,005,356

[45] Date of Patent: Dec. 21, 1999

[54] OPERATING METHOD AND OPERATING APPARATUS FOR A HIGH PRESSURE DISCHARGE LAMP

[75] Inventors: Makoto Horiuchi, Sakurai; Kiyoshi Takahashi, Neyagawa; Mamoru Takeda, Soraku-gun, all of Japan

[73] Assignee: Matsushita Electric Industrial Co., Ltd., Osaka, Japan

[21] Appl. No.: 08/954,729

[22] Filed: Oct. 20, 1997

[30] Foreign Application Priority Data

Oct. 21, 1996 [JP] Japan ..... 8-276749

[51] Int. Cl.[6] ..... H05B 37/02

[52] U.S. Cl. ..... 315/307; 315/82; 315/224; 315/176; 315/DIG. 7

[58] Field of Search ..... 315/307, 291, 315/82, 176, 224, DIG. 7, 246, 209 R; 313/184, 225, 229

[56] References Cited

U.S. PATENT DOCUMENTS

| | | | |
|---|---|---|---|
| 3,654,506 | 4/1972 | Kuhl et al. | 313/184 |
| 4,983,889 | 1/1991 | Roberts | 315/246 |
| 5,047,695 | 9/1991 | Allen et al. . | |
| 5,121,034 | 6/1992 | Allen et al. . | |
| 5,198,727 | 3/1993 | Allen et al. . | |
| 5,436,533 | 7/1995 | Fromm et al. . | |
| 5,684,367 | 11/1997 | Maskowitz et al. | 315/246 |
| 5,773,937 | 6/1998 | Miyazaki et al. | 315/246 |

FOREIGN PATENT DOCUMENTS

| | | |
|---|---|---|
| 0439861A1 | 8/1991 | European Pat. Off. . |
| 0443795A2 | 8/1991 | European Pat. Off. . |
| 502 273 A2 | 9/1992 | European Pat. Off. . |
| 0713352A2 | 5/1996 | European Pat. Off. . |
| 0785702A2 | 7/1997 | European Pat. Off. . |
| 4301184A1 | 7/1994 | Germany . |

OTHER PUBLICATIONS

H.P. Stormberg et al., "Excitation of Acoustic Instabilities in Discharge Lamps with Pulsed Supply Voltage" Lighting Research and Technology, vol. 15, No. 3, Mar. 1983, pp. 127–132.

*Primary Examiner*—Michael B Shingleton
*Attorney, Agent, or Firm*—Wenderoth, Lind & Ponack, L.L.P.

[57] ABSTRACT

A method and apparatus for operating a high pressure discharge lamp is disclosed. Oscillation in the discharge arc periphery, a problem that occurs with high frequency operation, is eliminated. A high pressure discharge lamp is operated by applying thereto a dc or rectangular wave current to which is superposed an ac component shaped by a high frequency ripple signal that has been amplitude modulated by a modulation signal for inducing instantaneous fluctuations in the power supply input to both ends of the arc gap. The ripple level is thereby temporally varied, and stable operating is possible even when exceeding the ripple level at which oscillation in the arc periphery begins.

26 Claims, 20 Drawing Sheets

OPERATING METHOD AND OPERATING APPARATUS FOR A HIGH PRESSURE DISCHARGE LAMP

BACKGROUND OF THE INVENTION

1. Field of the Invention

The present invention relates to a method for operating a high pressure discharge lamp containing a rare gas, mercury, metal halide, or other filler, and relates particularly to an operating method and operating apparatus whereby a high frequency alternating current component is supplied to a discharge lamp to control arc curvature.

2. Description of the Prior Art

An operating method for a high pressure discharge lamp according to related technology is described, for example, in the Proceedings of the 10th Anniversary session in 1983 of Tokyo branch of Illuminating Engineering Institute of Japan. The operating method described in these Proceedings operates a lamp by supplying a low frequency (several hundred hertz), rectangular wave ac current to the lamp. A problem with this operating method is that convection causes an undesirable curvature in the discharge arc when the discharge lamp is operated in a non-upright, e.g., horizontal, position, or more specifically, when the arc gap is horizontal. This curvature of the discharge arc creates a higher heat load in the top part of the discharge space, thus deteriorating the discharge envelope and shortening the service life of the lamp.

Various operating methods intending to suppress this discharge arc curvature have been proposed. One of these methods, as disclosed in Japan Examined Patent Publication (kokoku) 2-299197 (1990-299197), proposes to select a frequency of the voltage or current supplied to the lamp as a means of exciting acoustic resonance inside the discharge lamp envelope as a means of suppressing discharge arc curvature caused by convection. This specification further describes that modulating the operating frequency is advantageous as a means of expanding the frequency range that can be used for operating a lamp with a stable arc free of curvature, and as a means of compensating for ballast tolerance and the discharge tube manufacturing tolerance.

Another specification, disclosed in Japan Examined Patent Publication (kokoku) 7-9835 (1995-9835), teaches a method for supplying to a discharge lamp a unidirectional (dc) current having a superposed high frequency ripple-type ac current component. This ripple-type ac current component causes instantaneous lamp power fluctuations, which have the effect of inducing an acoustic resonance to suppress discharge arc curvature. This specification also teaches a method of frequency modulating the high frequency ripple ac component as a means of increasing the bandwidth of frequencies that can be used to obtain a straight, stable arc.

With the method described in Japan Examined Patent Publication (kokoku) 2-299197 (1990-299197), the frequency of the supply current used to operate a discharge lamp is selected for the purpose of inducing acoustic resonance inside the discharge envelope as a means of suppressing discharge arc curvature caused by convection. While this method achieves stability in the high luminance arc center (high temperature arc area), the surrounding low luminance arc area (low temperature arc area) can be unstable. This is described in further detail below with reference to FIG. 1.

Shown in FIG. 1 are the electrodes 100 determining the arc gap, the high luminance arc center 101, and the low luminance arc periphery 102 surrounding the high luminance arc center 101. As shown in FIG. 1, the high luminance arc center 101 is straight and stable. The low luminance arc periphery 102, however, exhibits unstable behavior fluctuating both vertically and horizontally with an appearance similar to a candle wavering In the breeze. It should be noted that this instability (wavering) of the low luminance arc periphery is not suppressed using the frequency modulation technique taught by Japan Examined Patent Publication (kokoku) 2-299197 (1990-299197). Details of topics with related conventional operating methods are described next below with reference to a discharge lamp comprised as shown in FIG. 2.

Referring to FIG. 2, a transparent quartz envelope 1 is sealed at both ends by seals 6*a* and 6*b*. A metal foil conductor 3*a* and 3*b* made from molybdenum is bonded to seals 6*a* and 6*b*, respectively. An electrode 2*a*, 2*b* and an external lead 4*a*, 4*b* also made from molybdenum are electrically connected to metal foil conductor 3*a* and 3*b*, respectively.

Each electrode 2*a*, 2*b* comprises a tungsten rod 7*a*, 7*b* and a tungsten coil 8*a*, 8*b*. The coil 8*a*, 8*b* is electrically bonded by welding to the end of the corresponding tungsten rod 7*a*, 7*b*, and functions as a radiator for the electrode 2*a*, 2*b*. The electrodes 2*a* and 2*b* are disposed inside the envelope 1 so that the gap therebetween, i.e., the arc gap, is approximately 3.0 mm.

The envelope 1 is roughly spherical with an inside diameter of approximately 10.8 mm and an internal volume of approximately 0.7 cc. The envelope 1 is filled with 4 mg of an iodide of indium (indium iodide, lnl) as a filler; 1 mg of holmium iodide ($HoI_3$) as a rare earth iodide; 35 mg of mercury as a buffer gas; and 200 mbar of argon as an inert gas for starting.

Concerns relating to generating an arc with a typical sine wave ac supply are described next below.

A high pressure discharge lamp comprised as described above is typically driven by supplying a sine wave shaped ac current supply from external leads 4*a*, 4*b*, thus energizing the arc gap in a horizontal position to output 200 W. As taught in Japan Examined Patent Publication (kokoku) 2-299197 (1990-299197), the frequency f was then adjusted between 10 kHz and 20 kHz and the arc was observed to select the frequency range acoustically straightening the arc. Observations showed that the high luminance arc center was straight and stable with a currency supply between 14 kHz and 16 kHz. More specifically, acoustic resonance eliminating discharge arc curvature was confirmed to be excited with a currency supply between 14 kHz and 16 kHz. However, careful observation of the arc resulting from this supply current frequency band also showed irregularly oscillating, unstable movement in the low luminance arc periphery as described above with reference to FIG. 1.

The results of these arc observations at various supply frequencies f are shown in FIG. 4. The white areas in FIG. 4 indicate a frequency band at which arc is stable in both the arc center and arc periphery, and the arc is straight. Shaded areas indicate frequencies at which the arc center is stable and straight, but the arc periphery is unstable. It should be noted that this oscillation is extremely irregular: there are cases when oscillation continues uninterrupted, and there are also cases when oscillation occurs only a few times per hour or less.

It should be further noted that while the frequency modulation method taught by Japan Examined Patent Publication (kokoku) 2-299197 (1990-299197) is able to suppress this oscillation of the arc periphery to a certain degree, this suppression simply reduces the number of oscillations and does not completely eliminate the oscillations.

Concerns relating to exciting an arc by supplying a rectangular wave current with a superposed high frequency ripple signal to the lamp are described next below.

Referring to the teaching of Japan Examined Patent Publication (kokoku) 7-9835 (1995-9835), a current comprising a high frequency ripple signal r superposed to a 100 Hz rectangular wave current k as shown in FIG. 5 was supplied to operate a discharge lamp as shown in FIG. 2. (It should be noted that the frequency fr of the high frequency ripple signal r inducing acoustic resonance must be twice the supply current frequency when a normal sine wave ac supply is used for operating because the lamp power frequency must be the same as when the lamp is operated with a sine wave ac supply.) Using the lamp shown in FIG. 2, the arc was again observed while varying the frequency fr of the high frequency ripple signal between 28 kHz and 32 kHz, the frequency at which acoustic resonance eliminating arc curvature occurs. Based on the teaching of Japan Examined Patent Publication (kokoku) 7-9835 (1995-9835) that the arc stabilization frequency band increases as the ripple becomes stronger, tests were conducted with the amplitude Ir of the high frequency ripple signal r set so that the ripple level, i.e., modulation depth (defined here as the amplitude Ir of high frequency ripple signal r divided by twice the effective lamp current) was substantially constant at 0.82. Observations showed that while the arc center was straight and stable throughout the 28 kHz to 32 kHz frequency band, irregular oscillation was present in the arc periphery.

The inventors of the present invention then measured the ripple level at which the arc periphery begins to stabilize at a particular frequency fr of a high frequency ripple signal r when the ripple level is varied by gradually varying the amplitude Ir of high frequency ripple signal r. The result is shown in FIG. 6. Operating points within the shaded area above line 6A in FIG. 6 are where the arc periphery is unstable (irregular oscillation); during operation under the curve, the arc periphery is stable (no oscillation).

As shown by these results, the frequency band at which a completely stable arc is achieved in both the arc center and the arc periphery narrows as the ripple level increases, i.e., as the amplitude Ir of the high frequency ripple signal r increases. As shown in FIG. 7, for example, a stable arc is obtained throughout the full frequency band 7A from 28 kHz to 32 kHz at a steady ripple level of 0.4. At a steady ripple level of 0.7, however, a stable arc is achieved only in frequency bands 7B and 7C, covering approximately 50% of the full band. When the ripple level is approximately 0.8 or above, the arc oscillates across the full frequency band. This result, it should be noted, is different from the teaching of Japan Examined Patent Publication (kokoku) 7-9835 (1995-9835) that the stable arc frequency band increases as the ripple level increases.

The result shown in FIG. 6 also means that as the ripple level increases in a high frequency ripple signal r of a constant frequency fr, i.e., as the amplitude Ir of the high frequency ripple signal r increases, the tolerance range to the ripple level at which oscillation starts in the arc periphery decreases, and arc instability tends to increase. This is described with reference to FIG. 8.

When the frequency fr of the high frequency ripple signal r is a constant 30.2 kHz as shown in FIG. 8, for example, the tolerance range to the start of arc periphery oscillation at a ripple level of 0.4 has a width equivalent to approximately 0.35 ripple level as shown by 8A in FIG. 8. The tolerance range at a ripple level of 0.7, however, narrows to approximately 0.05 ripple level as shown by 8B. This tendency applies to all frequencies fr.

The ripple level at which oscillation of the arc periphery begins (curve 6A in FIG. 8) may drop in a manner narrowing the stability range of the arc periphery (curve 6B, FIG. 8) as a result of manufacturing variations in the lamp and aging. To avoid such oscillation of the arc periphery, the amplitude Ir of high frequency ripple signal r must be set to a level lower than the ripple level at which arc periphery oscillation begins.

A ripple level between 0.5 to 0.6 is considered desirable because the frequency band through which a stable arc can be achieved is relatively wide, and the tolerance to a ripple level at which arc periphery oscillation begins is also relatively great.

The experimental results shown in FIG. 9, however, indicate a separate problem. The graph in FIG. 9 shows a relationship between ripple level and the amount of arc curvature when the frequency fr of the high frequency ripple signal r is a constant 30.2 kHz as above. This graph shows the ripple level on the horizontal axis, and the amount of arc curvature (distance from a center line joining the electrodes to the highest luminance point of the arc). As the value on the vertical axis rises, arc curvature increases (the arc rises to a greater height). FIG. 9 thus shows that arc curvature decreases as the ripple level increases, and that to achieve the smallest arc curvature, the ripple level should be 0.65, or preferably 0.7, or greater. To obtain a straight arc, the ripple level should be 0.5 or greater, and even more preferably should be 0.7 or greater.

SUMMARY OF THE INVENTION

The object of the present invention is therefore to provide a method and apparatus for operating a discharge lamp whereby the problem of unstable movement of the discharge arc in the periphery thereof is resolved.

To achieve this object, an operating method according to the present invention operates a high pressure discharge lamp by applying a discharge current between two electrodes where the discharge lamp comprises the two electrodes disposed with a specific discharge gap therebetween inside a transparent envelope. The envelope is substantially rotationally symmetrical in shape and is sealed with a noble gas or a noble gas compound, and a filler containing one or a plurality of metal halides, contained therein. The operating method of the invention energizes a high pressure discharge lamp by generating a high frequency ripple signal of a first frequency, amplitude modulating the high frequency ripple signal by a modulation signal of a second frequency that is lower than the first frequency, and operating a high pressure discharge lamp by applying a discharge current to both ends of the discharge gap by the amplitude-modulated high frequency ripple signal.

The polarity of the amplitude-modulated high frequency ripple signal is preferably caused to alternate by an ac signal alternating at a third frequency that is lower than the second frequency. In addition, the maximum ripple level of the amplitude-modulated high frequency ripple signal is preferably within the discharge arc instability range in which irregular oscillation in the arc periphery occurs, and the minimum ripple level is preferably set outside the discharge arc instability range.

The ac signal is preferably a rectangular wave signal where the third frequency is in the range from 50 Hz to 1 kHz. The modulation signal can, however, be a sine wave, triangular wave, sawtooth wave, rectangular wave, exponential function wave, or composite wave.

Further preferably, the second frequency is in the range from 50 Hz to 1 kHz, and the first frequency is a frequency exciting acoustic resonance having the effect of reducing discharge arc curvature caused by convection inside the transparent envelope.

Alternatively, the high frequency ripple signal is amplitude modulated by a modulation signal such that the maximum amplitude of the high frequency ripple signal is 1.5×Irms (peak-to-peak) and the minimum amplitude is 1.1×Irms (peak-to-peak), where Irms is the effective value of the discharge current.

An exemplary high pressure discharge lamp to which the above operating method is preferably applied contains a metal hallide capable of emitting light in the low temperature discharge arc area sealed inside the transparent envelope, and the metal halide is preferably the one of the following rare earth elements or a compound thereof: terbium (Tb), dysprosium (Dy), holmium (Ho), erbium (Er), and thulium (Tm).

Other objects and attainments together with a fuller understanding of the invention will become apparent and appreciated by referring to the following description and claims taken in conjunction with the accompanying drawings.

DESCRIPTION OF PREFERRED EMBODIMENTS

An operating apparatus for reducing instability of the arc periphery is described next below according to the present invention.

Figure 2:
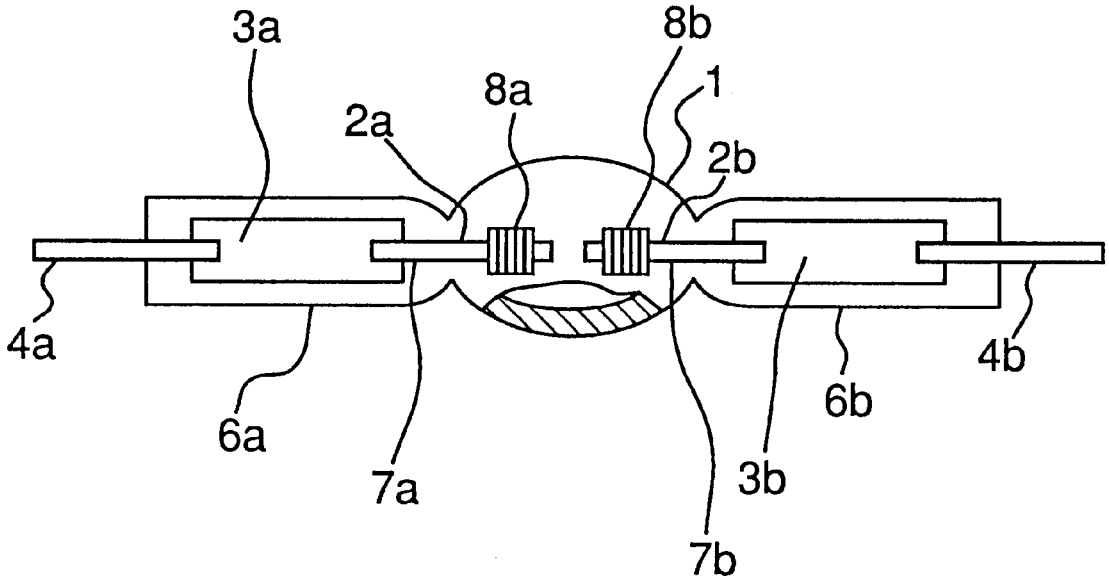
FIG. 2 is a cross sectional diagram of a high pressure discharge lamp appropriate for use with the preferred embodiments of the present invention.
Figure 3:
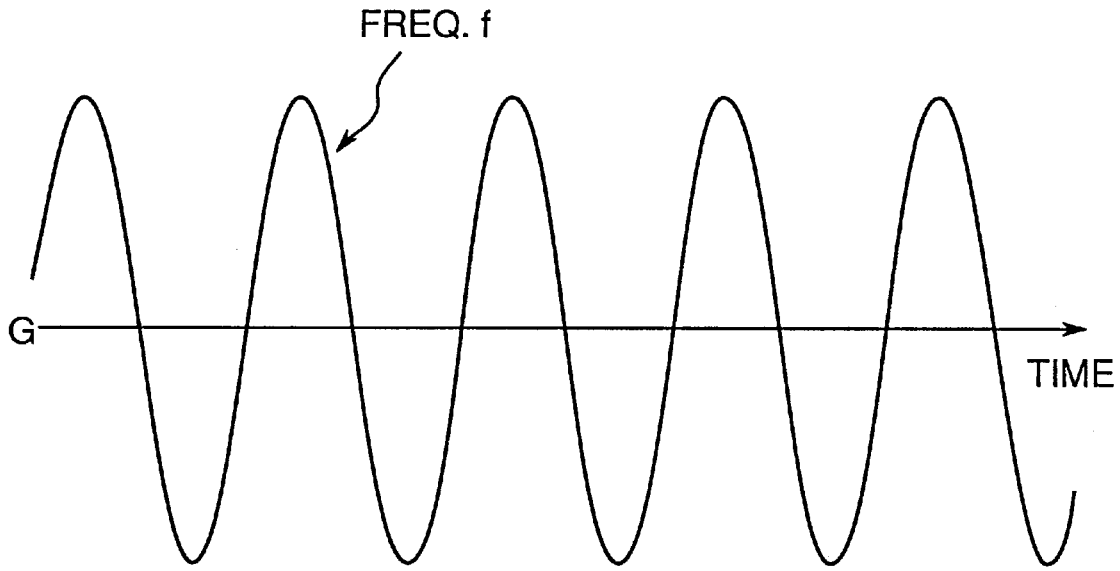
FIG. 3 is a waveform diagram of the lamp current when a high pressure discharge lamp is operated by a conventional sine wave current supply.
Figure 4:
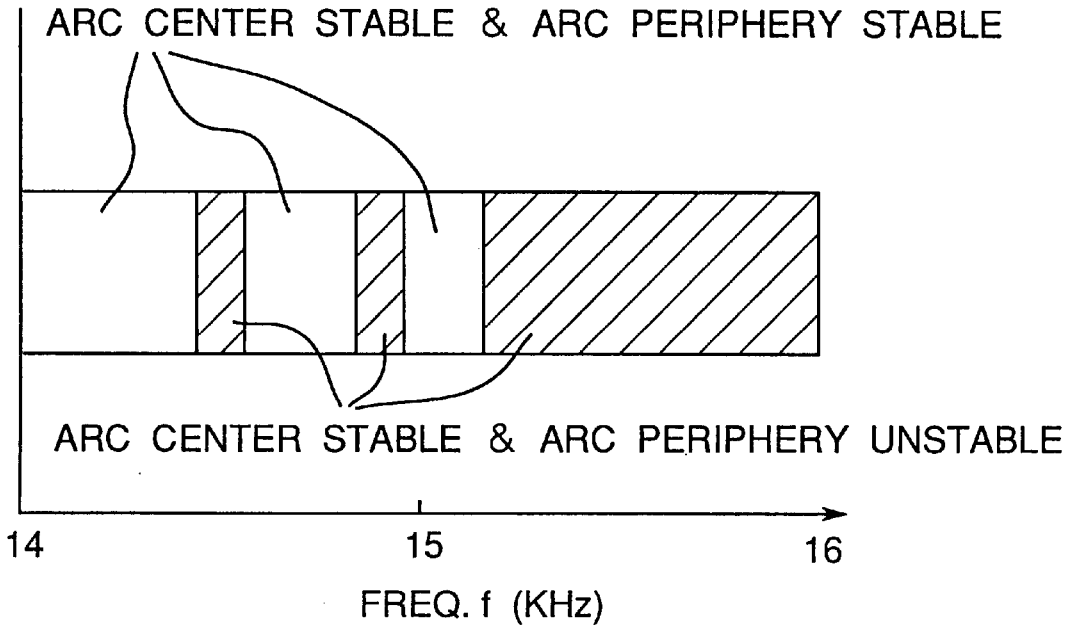
FIG. 4 is a diagram showing the relationship between arc stability and frequency when a high pressure discharge lamp is operated by a conventional sine wave current supply.
Figure 18:
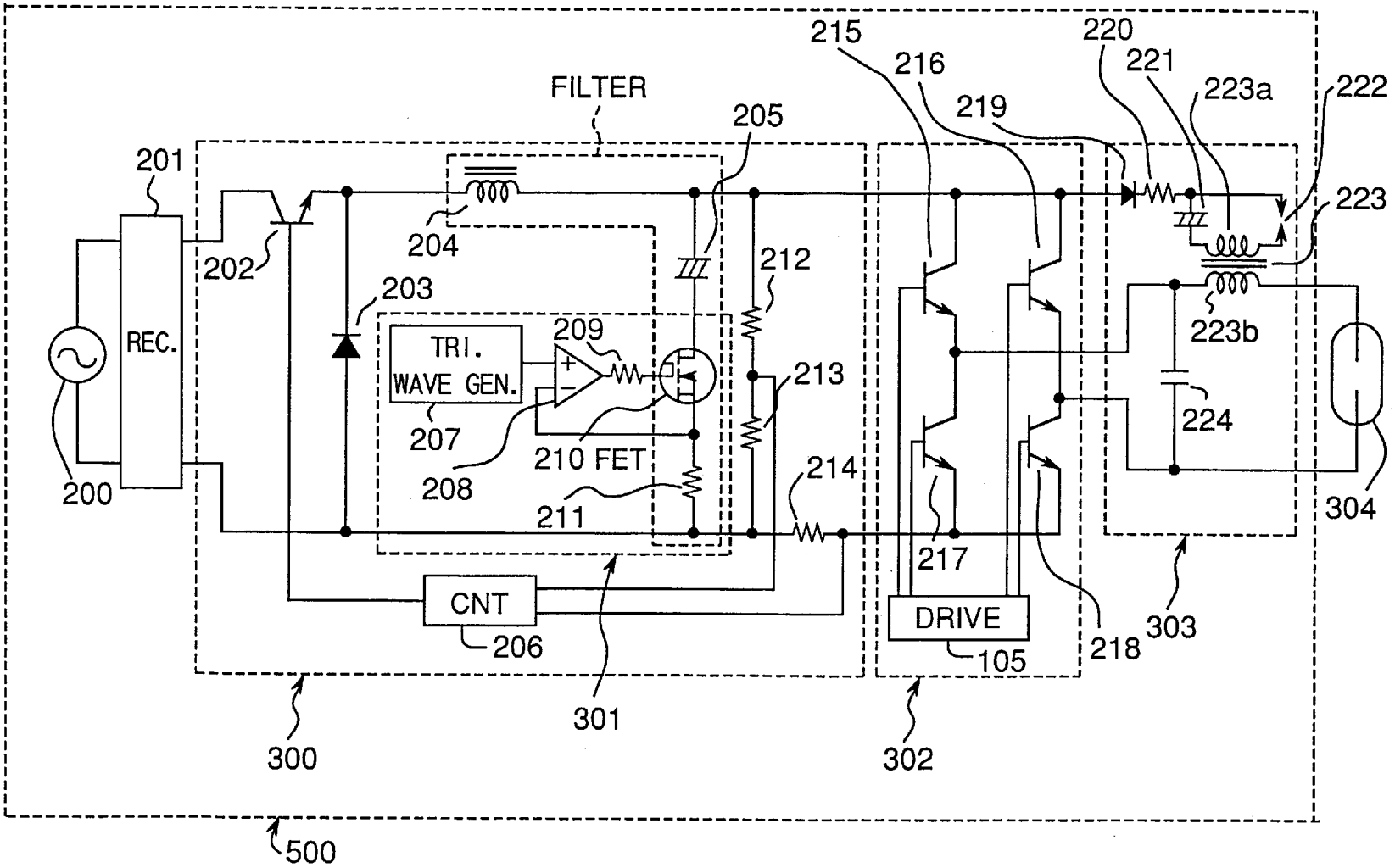
FIG. 18 is a circuit diagram of an operating apparatus according to a preferred embodiment of the present invention.

FIG. 18 is a circuit diagram of an operating apparatus according to a preferred embodiment of the present invention. The operating apparatus 500 shown in FIG. 18 starts and operates a 200-W high pressure discharge lamp 304, which is comprised as described above with reference to FIG. 2. A rectification and smoothing circuit 201 is connected to the ac power source 200 for converting the output voltage of the ac power source 200 to a dc voltage supplied to the dc power supply 300.

The dc power supply 300 superposes a 30.2 kHz high frequency ripple signal on the dc voltage output therefrom. Note that this 30.2-kHz frequency is a frequency achieving a straight discharge arc. The output of the dc power supply 300 is shown in FIG. 19B.

Figure 19A:
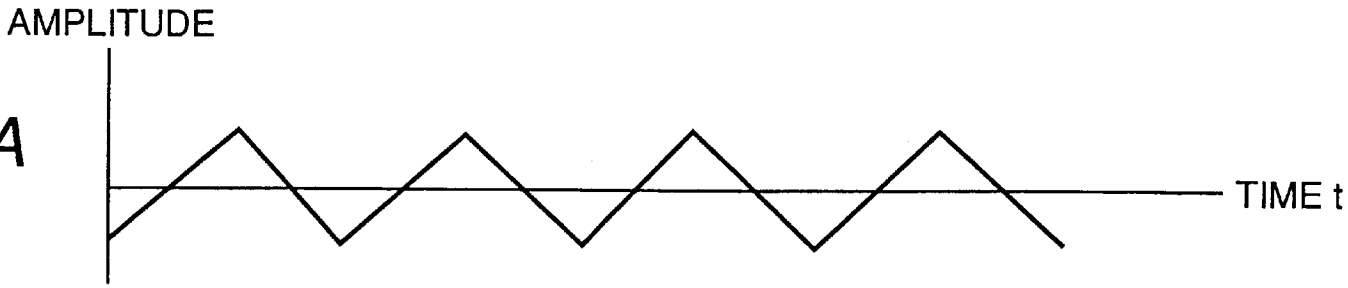
FIG. 19A and 19B are waveform diagrams of the output signal from the dc power supply 300.
Figure 19B:
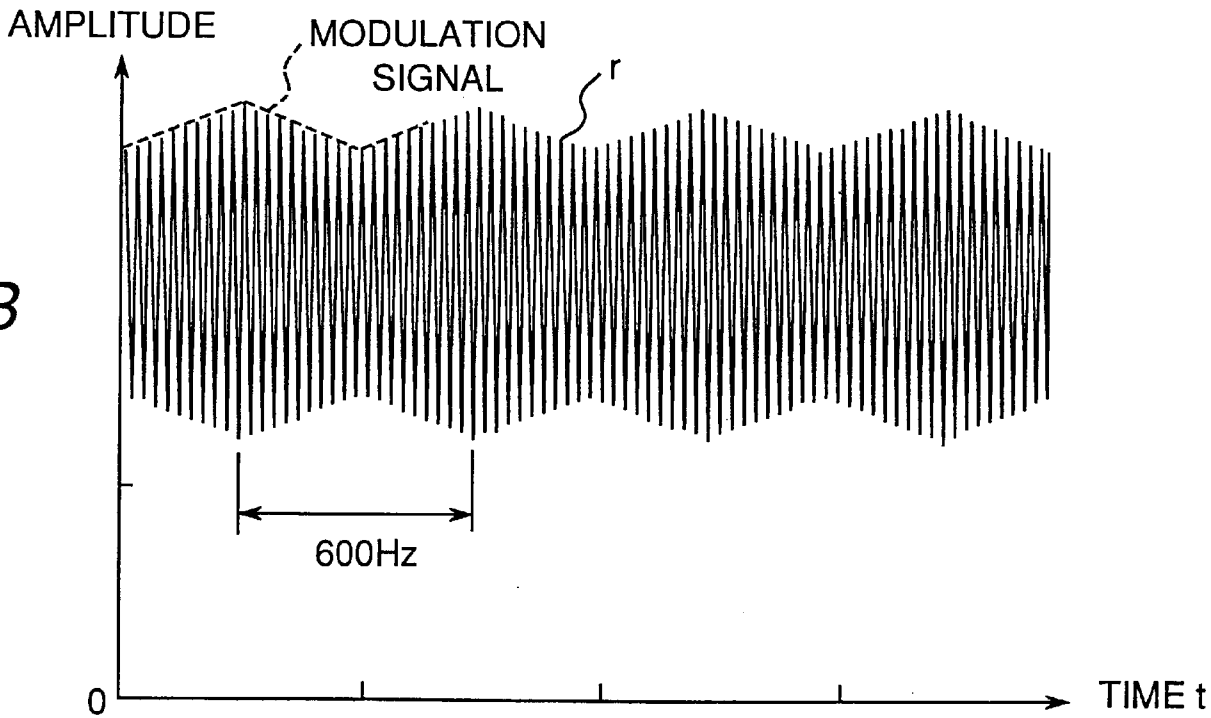

An amplitude modulation circuit 301 modulates the amplitude of the high frequency ripple signal to a 600-Hz triangular wave (FIG. 19A). Note that the maximum frequency of this triangular wave is the frequency of the high frequency ripple signal.

A rectangular wave converter 302 is an inverter circuit for converting the polarity of the amplitude-modulated dc voltage with a superposed high frequency ripple at a frequency of which the upper limit is the frequency of the high frequency ripple signal.

The starter circuit 303 generates a high voltage sufficient to facilitate the start of arc discharging by the high pressure discharge lamp 304, and applies this voltage to the high pressure discharge lamp 304.

A dc supply produced by the ac power source 200 and rectification and smoothing circuit 201 is input to the dc power supply 300. A step-down chopper comprises a transistor 202 as a switch element, a diode 203, a choke coil 204 creating inductance, a capacitor 205, a FET 210, and a resistor 211.

A control circuit 206 determines the lamp power from a signal detected by resistors 212 and 213 as equivalent to the lamp voltage, and a signal detected by resistor 214 as equivalent to the lamp current, and controls the on-off ratio of transistor 202 to maintain a constant 200-W output while the lamp is energized and stable. Note that this on-off frequency of the transistor 202 is set to 30.2 kHz, i.e., a frequency determined to excite a mode straightening the discharge arc.

A filter circuit comprises choke coil 204, capacitor 205, and FET 210 and resistor 211, which are also part of the amplitude modulation circuit 301. Note that this filter circuit does not cut the 30.2 kHz frequency component. The output terminal of the filter is the connection node between the choke coil 204 and capacitor 205, and the dc power supply 300 thus outputs a dc current (FIG. 19B) with a superposed 30.2-kHz high frequency ripple signal.

The amplitude modulation circuit 301 comprises a triangular wave generator 207. The output signal (FIG. 19A) of the triangular wave generator 207 is passed through an operating amplifier 208 and resistor 209, and applied to the gate of the FET 210, which functions as a variable resistor. The FET 210 and resistor 211 are connected in series with the capacitor 205. As a result, the amplitude of the high frequency ripple signal can be changed by changing the resistance of the FET 210. More specifically, increasing the resistance of the FET 210 increases the impedance at both ends of the capacitor 205, FET 210, and resistor 211. The amplitude of the high frequency ripple signal superposed on the output of the dc power supply 300 increases. When the resistance of the FET 210 is reduced, the impedance of the filter circuit is reduced, and the amplitude of the high frequency ripple signal becomes lower. Note that the resistance of the FET 210 varies approximately proportionally to the amplitude of the gate terminal input signal, i.e., the output signal from the triangular wave generator 207.

Figure 1:
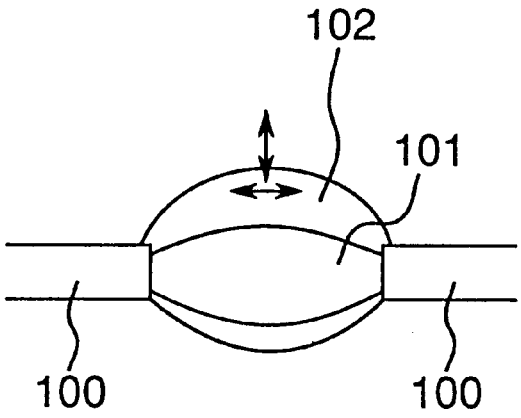
FIG. 1 is a diagram showing discharge arc instability resulting from a conventional operating method.
Figure 9:
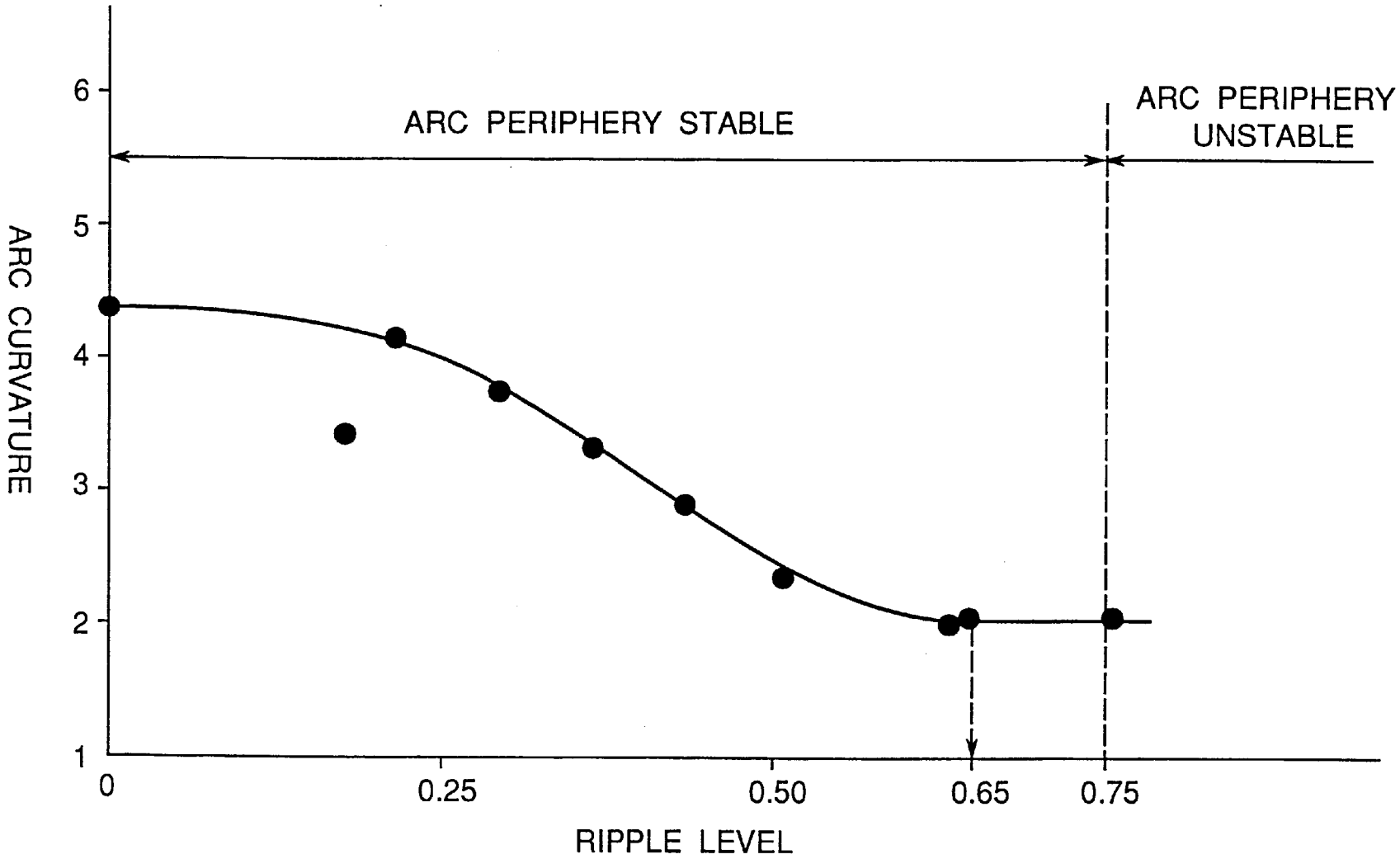
FIG. 9 is a graph of the relationship between ripple level and discharge arc curvature.

As shown in FIG. 1 9B, the output of the dc power supply 300 is the product of amplitude modulating with a 600-Hz triangular wave the 30.2-kHz high frequency ripple signal r superposed to a dc supply. More specifically, the output of the dc power supply 300 is obtained by superposing a high frequency ripple signal with a temporally variable ripple level (amplitude) to a dc current. Note that the ripple level is defined here as the amplitude Ir of high frequency ripple signal r divided by twice the effective value of the lamp current. It should be further noted that the amplitude of the output signal from the triangular wave generator 207, i.e., the amplitude of the signal determining the amount of ripple level variation, is set so that the maximum change in the ripple level is 0.75 ripple level, and the minimum change is 0.55 ripple level, when the high pressure discharge lamp 304 is operated to a constant 200-W output.

Figure 20:
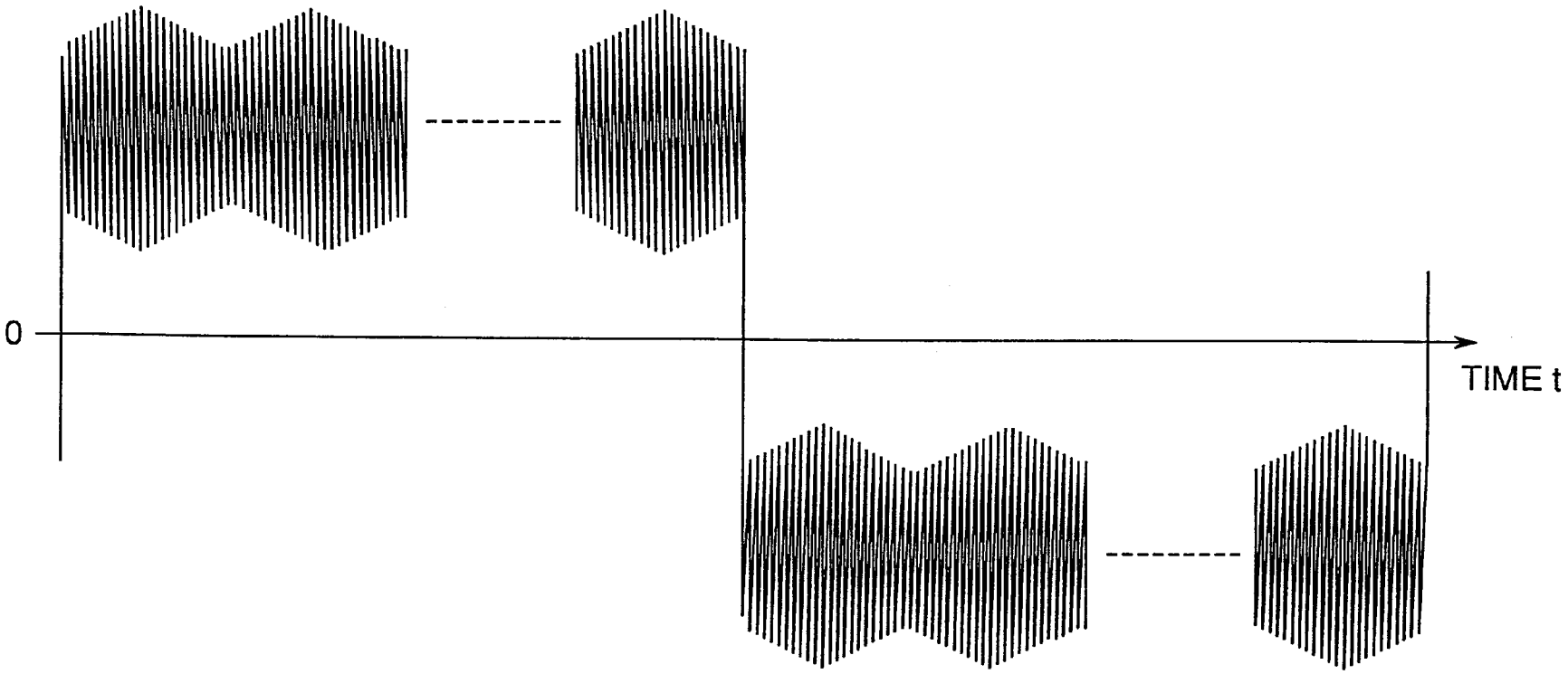
FIG. 20 is a waveform diagram of the output signal from the rectangular wave converter 302.

The rectangular wave converter 302 comprises transistors 215, 216, 217, and 218, and drive circuit 305. The drive circuit 305 controls the alternating on-off state of transistors 215 and 218 and transistors 216 and 217 to maintain an ac frequency of 100 Hz in the output from the rectangular wave converter 302. The rectangular wave converter 302 converts the output signal from the dc power supply 300 (FIG. 19B) to a 100-Hz rectangular wave ac signal, which is output therefrom as shown in FIG. 20. This ac signal is then passed through the starter circuit 303 and supplied to the high pressure discharge lamp 304.

The starter circuit 303 comprises a discharge gap 222, a diode 219, a resistor 220, a pulse transformer 223, and capacitors 221, 224. The discharge gap 222 starts discharging before the high pressure discharge lamp 304 starts at a particular voltage that is lower than the output voltage of the dc power supply 300. A secondary winding 223*b* of the pulse transformer 223 is connected in series to the high pressure discharge lamp 304. This series circuit and the capacitor 224 are connected parallel to the output terminal of the rectangular wave converter 302. The primary winding 223*a* of the pulse transformer 223 is connected in series to the discharge gap 222, and this series circuit is parallel connected to the capacitor 221. The output voltage of the dc power supply 300 passes the diode 219 and resistor 220 to charge the capacitor 221.

As a result, when the discharge gap 222 starts discharging, the voltage charged to the capacitor 221 is applied to the primary winding 223*a* of the pulse transformer 223. A high pulse voltage boosted by the pulse transformer 223 is thus output from the secondary winding 223*b* of the pulse transformer 223, and applied to the high pressure discharge lamp 304 through capacitor 224. When high pressure discharge lamp 304 begins lighting, the output of the dc power supply 300 drops, and the discharge gap 222 stops operating. Supply of a high pulse voltage also stops.

After a high pressure discharge lamp 304 is thus started by applying a high pulse voltage from the starter circuit 303 as described above, a 100-Hz ac current as shown in FIG. 20 is thereafter supplied. As described above, this ac current is produced by amplitude modulating a high frequency ripple signal with a triangular wave signal supplied from the triangular wave generator 207 (FIG. 19B), and then varying the polarity of this amplitude modulated signal with a 100-Hz rectangular wave. The amplitude of the output signal from the triangular wave generator 207 varies at a frequency of 600 Hz, and is therefore controlled such that when the high pressure discharge lamp 304 is operated to a constant 200-W output, the ripple level is 0.75 ripple level at the maximum amplitude Irmax of the signal shown in FIG. 19B, and is 0.55 ripple level at the minimum amplitude Irmin.

It is therefore possible to maintain the high pressure discharge lamp 304 operated with a straight discharge arc without creating or growing instability in the arc periphery.

Figure 6:
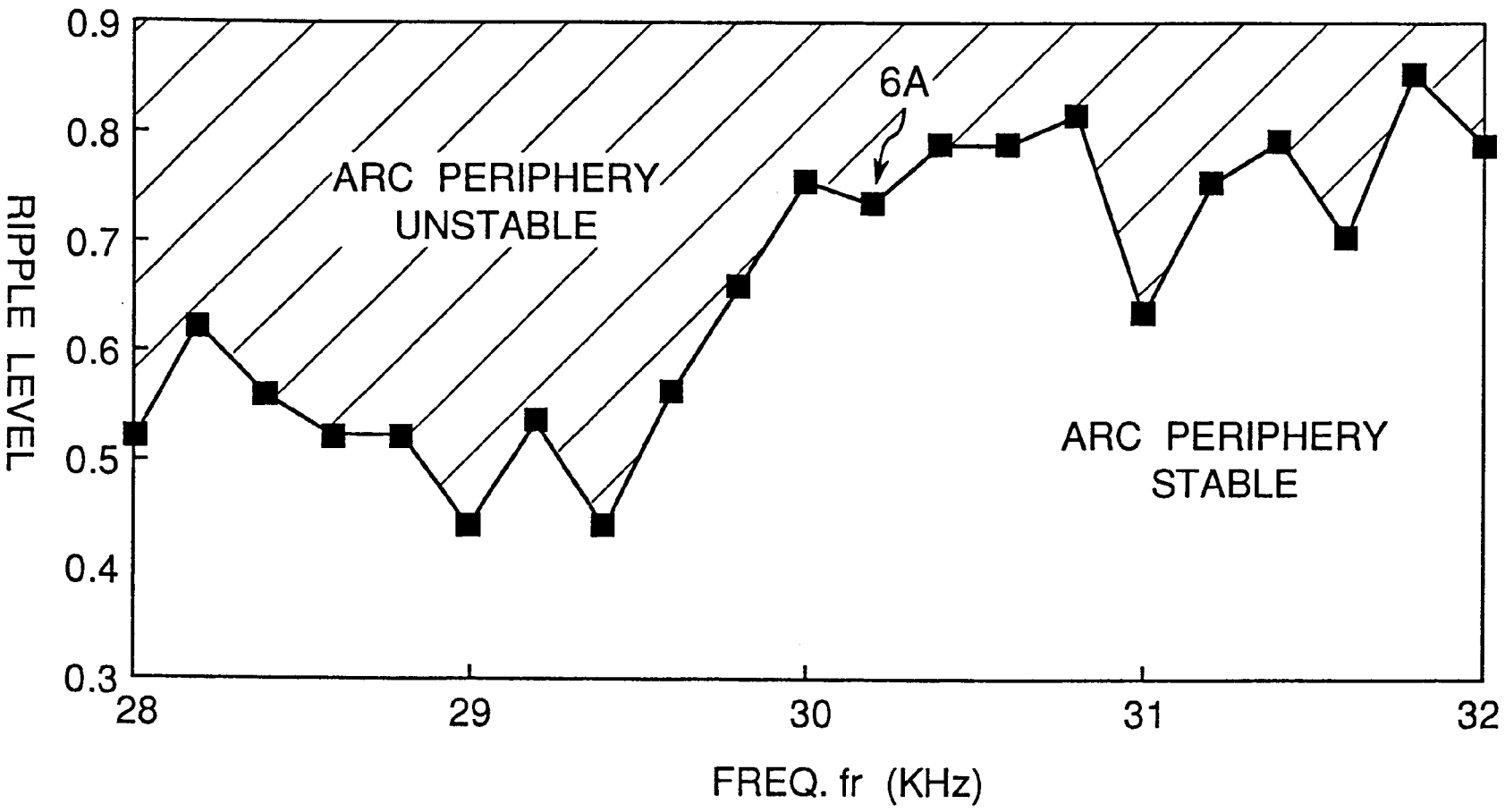
FIG. 6 is a graph of the relationship between ripple level and arc instability.

Because the ripple level of the high frequency ripple signal is constantly changing, the chance of driving the high pressure discharge lamp 304 at an irregularly appearing ripple level that enables the creation or growth of instability in the arc periphery is less than if a constant ripple level is used. This operating apparatus can furthermore suppress the occurrence of irregular oscillation in the arc periphery when the ripple level at which oscillation in the arc periphery begins (line 6A in FIG. 6) drops as a result of discharge lamp manufacturing variations or aging.

It should be noted that the frequency of the high frequency ripple signal is set to 30.2 kHz as this frequency excites a mode that straightens the discharge arc, but it will also be obvious that another frequency can be used within the scope of the present invention. More specifically, a frequency in the range from 30.2 kHz to 32 kHz is preferable for a high pressure discharge lamp 304 as described above based on the findings shown in FIG. 6.

It should be further noted that the frequency exciting a discharge arc-straightening mode depends upon the shape of the high pressure discharge lamp. This means that the preferable frequency range of the high frequency ripple signal will obviously differ for high pressure discharge lamps differing in structure from the high pressure discharge lamp 304 described above. For example, a range from 140 kHz to 160 kHz is preferable for 35-W metal halide lamps used in automobiles today.

The frequency of the high frequency ripple signal can be easily changed by adjusting the on-off frequency of the transistor 202.

In addition, the amplitude of the output signal from the triangular wave generator 207 can be changed to control the change in the amplitude of the high frequency ripple signal to a ripple level whereby discharge arc instability can be decreased. The change in the amplitude of the high frequency ripple signal can also be easily controlled by appropriately adjusting the choke coil 204, capacitor 205, and resistor 211.

Figure 14A:
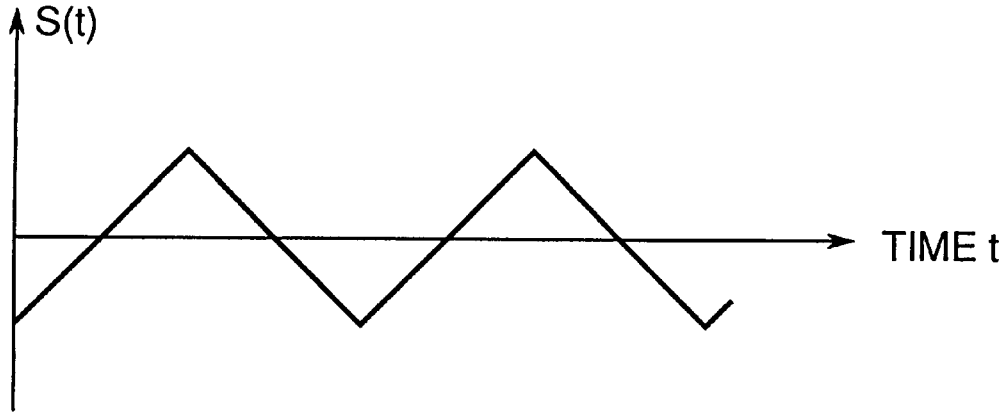
FIGS. 14A, 14B and 14C are graphs used to describe a modulation signal s(t) according to an alternative embodiment of the invention.
Figure 14B:
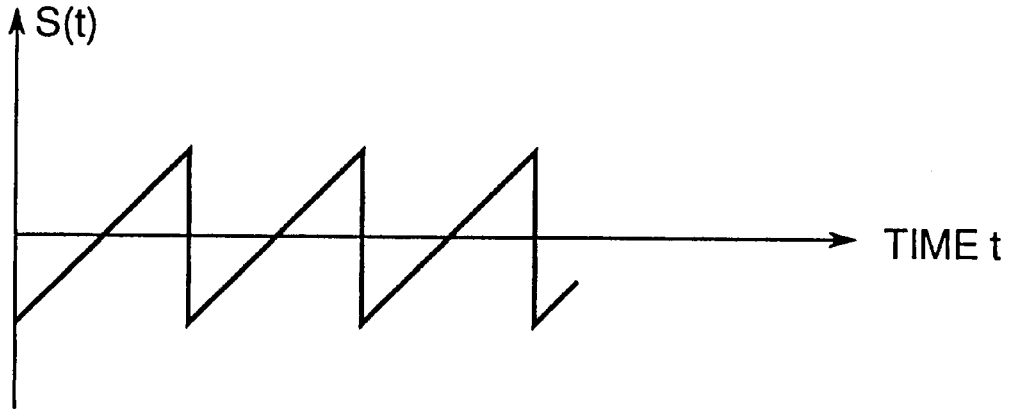
Figure 14C:
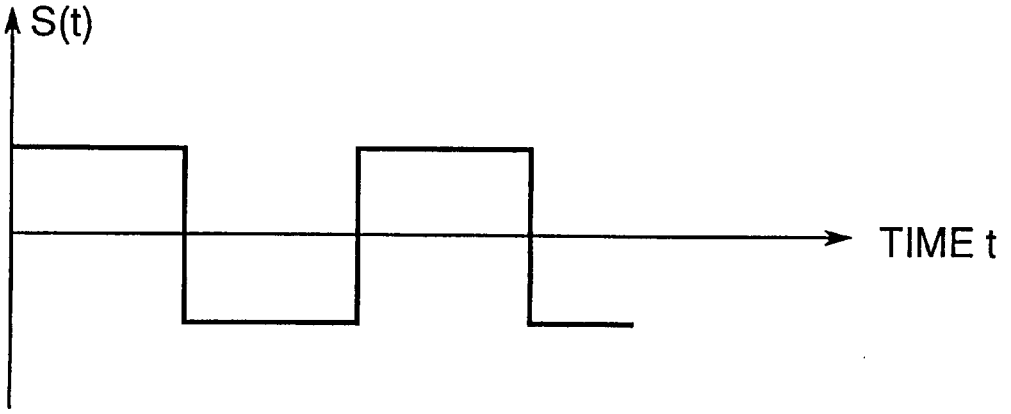

It should be further noted that the triangular wave generator 207 can be replaced by a generator producing a different wave shape. The modulation signal output from the wave generator can be a sawtooth wave or rectangular wave as shown in FIGS. 14B and 14C, as well as a sine wave or composite wave.

Furthermore, the modulation signal frequency is defined as 600 Hz above, but can be selected from a frequency range of which the upper limit is the frequency of the high frequency ripple signal. The modulation signal frequency is preferably in the range from 50 Hz to 1 kHz.

In the exemplary embodiment described above the dc power supply 300 above is based on a step-down chopper, but other configurations capable of outputting a dc supply with a superposed high frequency ripple signal can be alternatively used, including a step-up chopper, inverting chopper, and forward converter.

A transistor 202 is also described above as a switch element, but an FET, thyristor, IGBT, or other element can be alternatively used.

The control circuit 206 is comprised for controlling the on-off ratio of the transistor 202 to maintain lamp output constant at a rated 200 W. It may be alternatively comprised to supply power exceeding the rated power supply at the start of lamp energizing to compensate for the light output when the discharge lamp is turned on. The control circuit 206 can be further comprised as a dimmer control or other means for variably controlling the lamp characteristics.

The input to the dc power supply 300 is the rectified ac power source 200 output by the rectification and smoothing circuit 201, but a different dc supply can be used.

Figure 21:
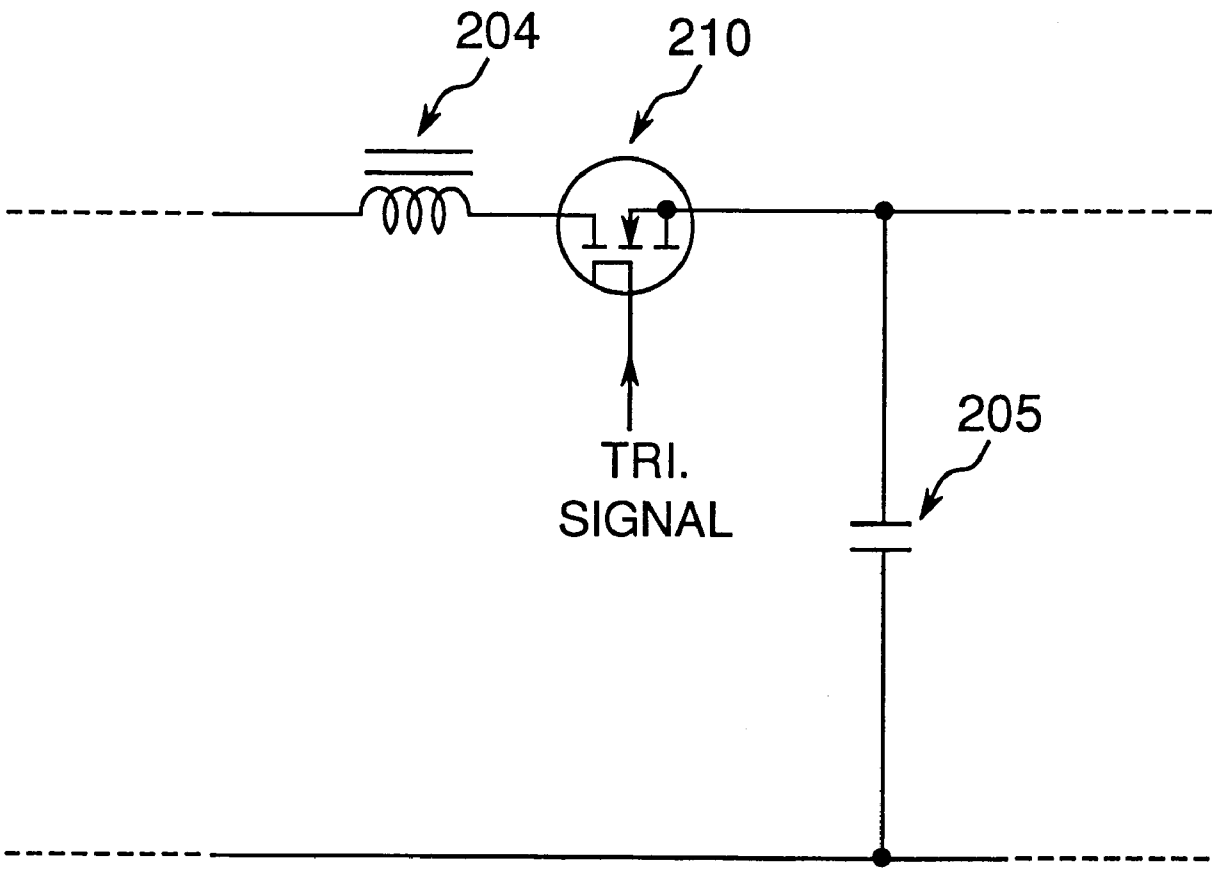
FIG. 21 is a circuit diagram of an amplitude modulation circuit 301 according to an alternative embodiment of the present invention.

The FET 210 used as a variable resistor of the amplitude modulation circuit 301 can also be replaced by, for example, a transistor. Furthermore, while the FET 210 is described as connected in series with the capacitor 205, it can be alternatively connected in series with the choke coil 204 as shown in FIG. 21.

In addition, the rectangular wave converter 302 is described above as generating a standard rectangular wave. The rectangular wave converter 302 can, however, be differently comprised insofar as the converter can produce a rectangular wave, or can be comprised to produce a waveform other than a rectangular wave insofar as the polarity of the waveform changes with a maximum frequency equal to the frequency of the high frequency ripple signal. Examples of such alternative waveforms include a trapezoidal wave with a sloping rise and fall, a nearly rectangular wave, a sine wave, a triangular wave, a stair-step wave, and a sawtooth wave. The signal may also contain a slight dc component, and can be asymmetrical. When the discharge lamp is operated with a dc supply, the rectangular wave converter 302 can also be eliminated.

The output frequency of the rectangular wave converter 302 is also set to 100 Hz in the exemplary embodiment above, but this frequency can be appropriately selected from a frequency range of which the upper limit is the high frequency ripple signal frequency, and is preferably from 50 Hz to 1 kHz.

Figure 22:
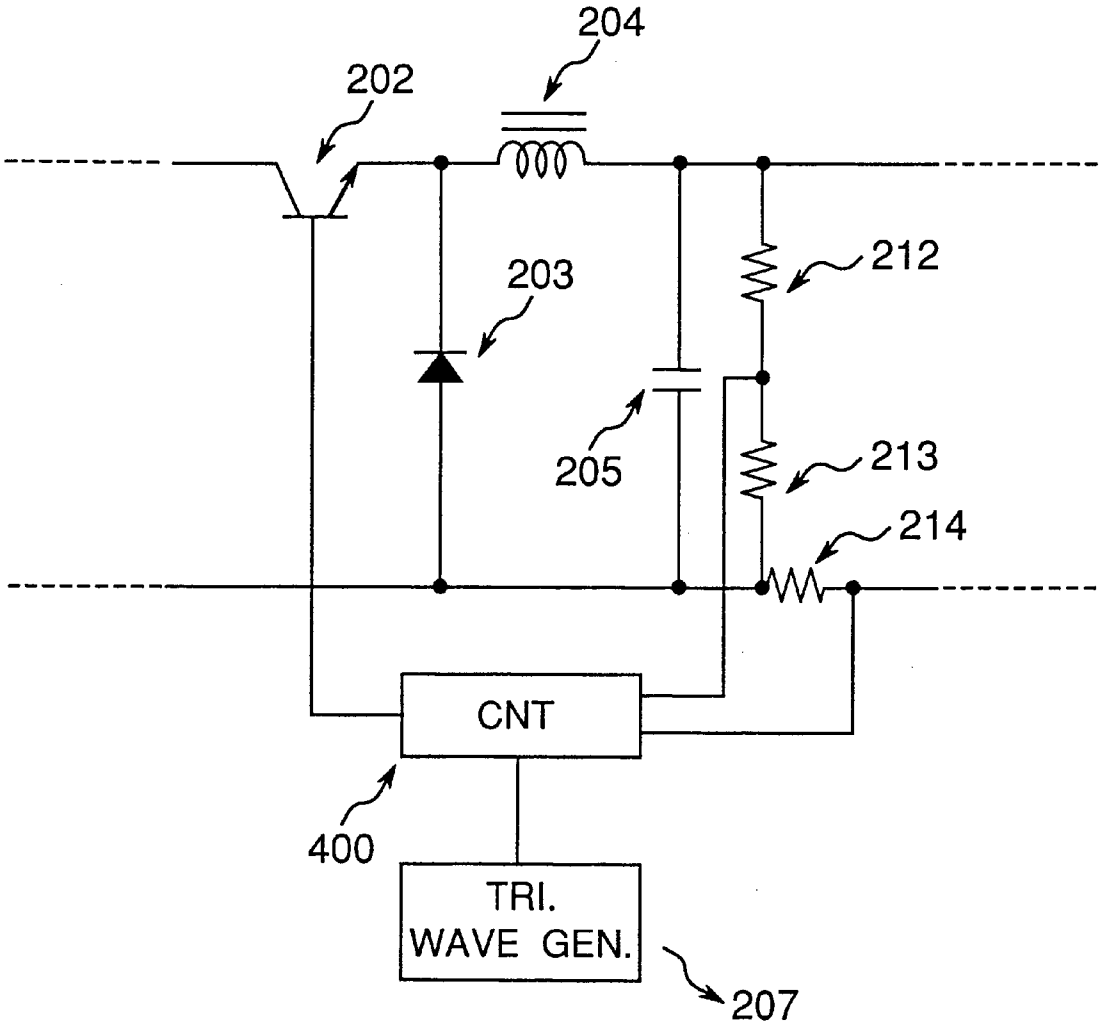
FIG. 22 is a circuit diagram of a dc power supply 300 according to an alternative embodiment of the present invention.

The frequency characteristic of the filter comprising a choke coil 204, capacitor 205, FET 210, and resistor 211 in the dc power supply 300 is adjusted by varying the resistance of the FET 210. It is also possible, however, to control the filter circuit frequency characteristic using a control circuit 400 as shown in FIG. 22. In this case the control circuit 400 determines the lamp power from a signal detected by resistors 212 and 213 as equivalent to the lamp voltage, and a signal detected by resistor 214 as equivalent to the lamp current, and controls the on-off ratio of transistor 202 to maintain a constant 200-W output. The control circuit 400 can also detect the output signal of the triangular wave generator 207 to adjust the on-off frequency according to the signal level.

When the on-off frequency of the transistor 202 changes, the frequency of the high frequency ripple signal also changes. This changes the impedance of the pulse transformer 223, and changes the amplitude of the high frequency ripple signal. As the on-off frequency ot the transistor 202 rises, the amplitude of the high frequency ripple signal decreases, and as the on-off frequency drops, the high frequency ripple signal amplitude increases. As a result, the output signal from the triangular wave generator 207 can be used as an amplitude modulation signal for modulating the amplitude of the high frequency ripple signal.

It should be further noted that while the high pressure discharge lamp 304 of the preferred embodiment is described above as being a metal halide lamp, the invention shall not be so limited. More specifically, the present invention will have the same effect with other types of high pressure discharge lamps, including high pressure mercury vapor lamps, xenon lamps, and high pressure sodium vapor lamps.

Suppression of irregular oscillation in the arc periphery as achieved by an operating apparatus according to the present invention is described further below.

Figure 7:
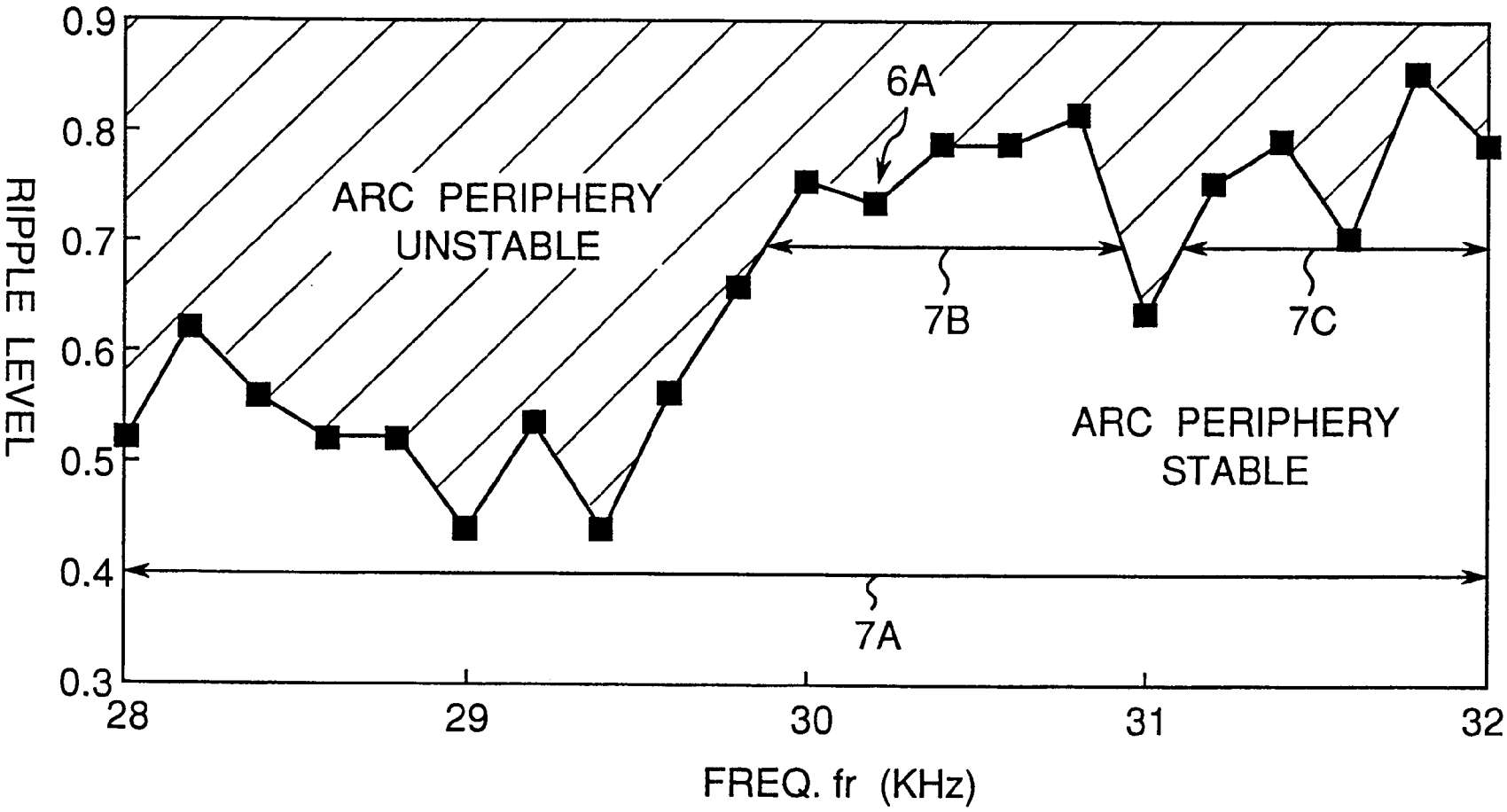
FIG. 7 is a graph of the relationship between ripple level and the frequency at which the discharge arc is stable.
Figure 8:
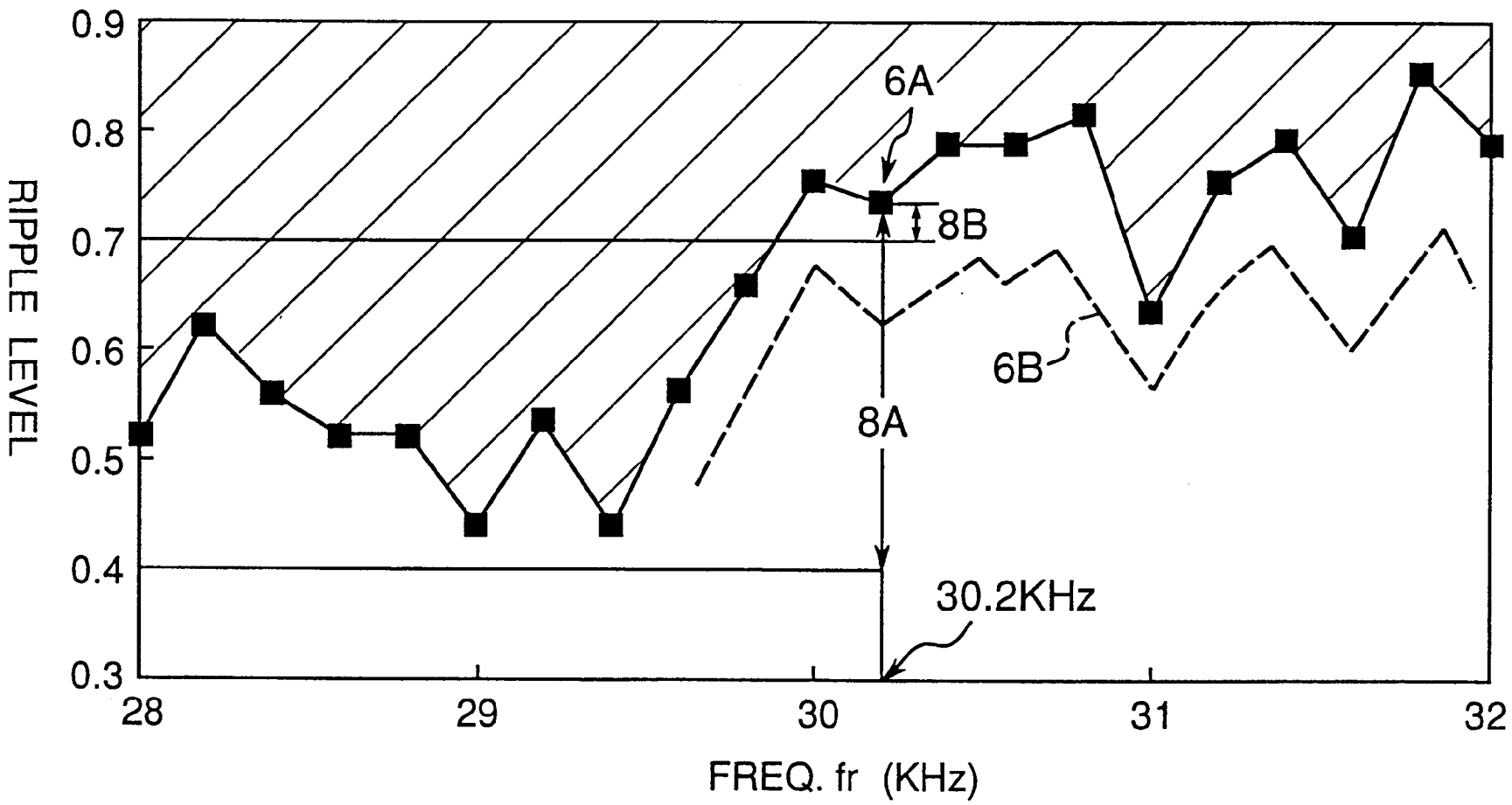
FIG. 8 is a graph of the relationship between ripple level and the ripple level at which the discharge arc become unstable.

As described above with reference to FIG. 7, the ripple level is preferably minimized as a means of preventing oscillation in the arc periphery. As also described with reference to FIG. 9, however, the ripple level is preferably maximized as a means of straightening the discharge arc. The operating apparatus shown in FIG. 18, however, achieves both of these objectives, preventing irregular oscillation in the arc periphery and straightening the discharge arc.

Figure 10:
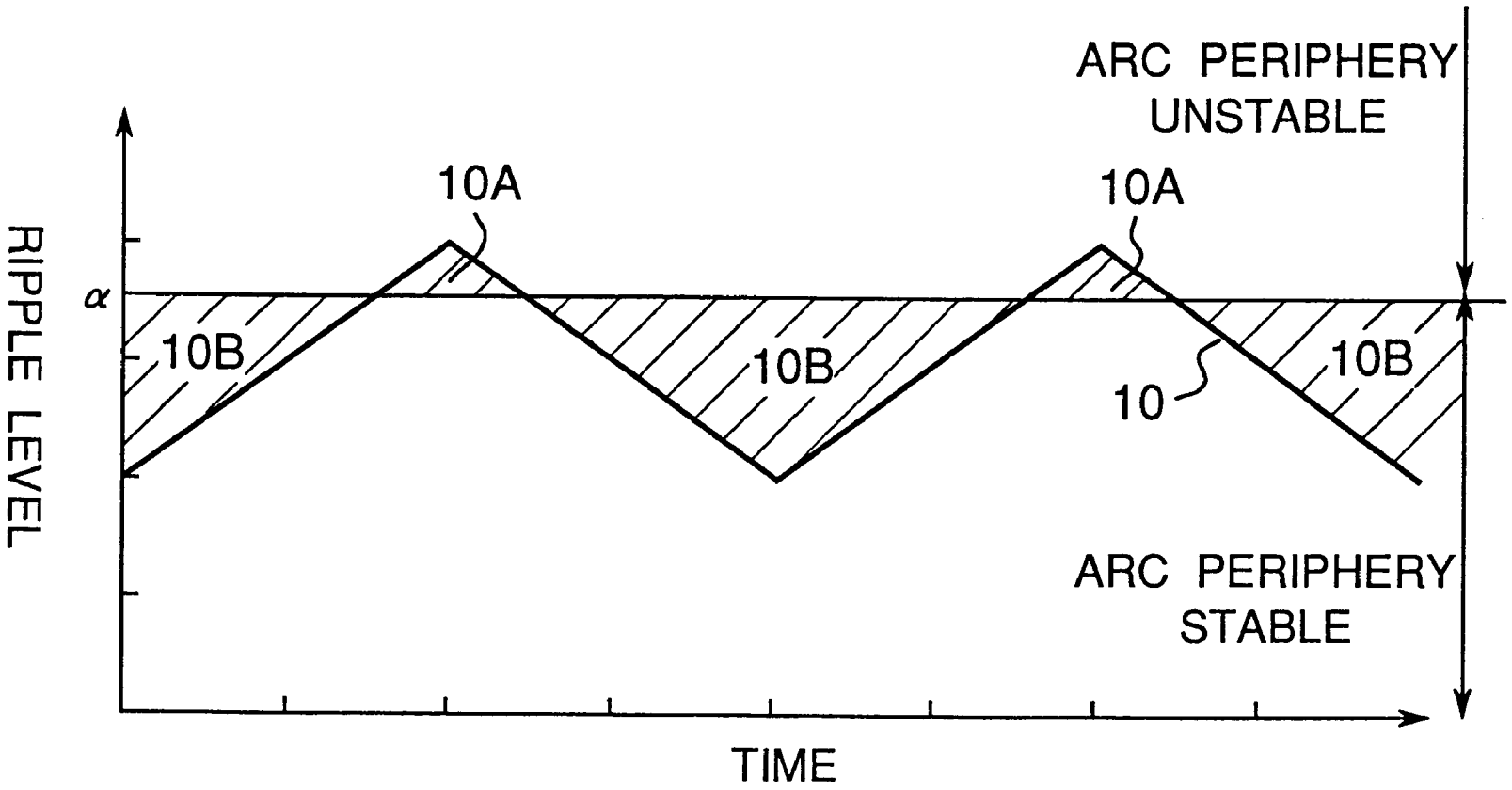
FIG. 10 is a graph used to describe the allowance to arc periphery instability when a high pressure discharge lamp is driven with a temporally variable ripple level according to a preferred embodiment of the present invention.

The relationship between the ripple level and time in an operating apparatus according to the present invention is shown in FIG. 10. It should be noted that amplitude modulation of the high frequency ripple signal with a triangular wave results in a triangular wave-shaped change in the ripple level over time.

Furthermore, when the ripple level thus changes over time in a wave-shaped pattern, there are alternating periods of instability 10A and stability 10B in the arc periphery. It should be noted that the period of instability 10A occurs when the discharge lamp is driven with a ripple level exceeding the ripple level a at which the arc periphery becomes unstable (ripple level a=0.75 when the frequency of the high frequency ripple signal r is 30.2 kHz), and period. of stability 10B occurs below ripple level a. Furthermore, irregular oscillation in the arc periphery can be suppressed regardless of the size of periods of instability 10A and stability 10B insofar as they occur in alternating order.

In a preferred embodiment of the invention, the area of instability period 10A is less than the area of stability period 10B as this relationship prevents arc instability from growing, and thus prevents irregular oscillation in the arc periphery.

Even more specifically, by continuously varying the ripple level, the operating method of the present invention reduces the probability of instability in the arc periphery developing and growing when compared with methods whereby the ripple level remains constant.

Instability in the arc periphery is similar to what happens when stored energy is suddenly discharged. In this analogy energy is stored in instability period 10A, and energy is not stored in stability period 10B. While operation remains in stability period 10B, energy is not stored, and the arc periphery therefore does not become unstable, Arc straightening is also not achieved because the ripple level is low. On the other hand, if operation remains in instability period 10A, energy continues to be stored until it is suddenly discharged at some point, thereby destabilizing the arc periphery.

The method of the present invention prevents this sudden discharge of stored energy, however, by alternating stability period 10B and instability period 10A. This also makes it possible to maintain a higher average ripple level, and enables arc straightening.

It is also possible by means of the present invention to suppress the occurrence of oscillation in the arc periphery when the ripple level at which oscillation in the arc periphery begins (line 6A in FIG. 6) drops as a result of discharge lamp manufacturing variations or aging.

It should be further noted that the ripple level is divided into periods of stability and instability using as the boundary therebetween the ripple level at which oscillation in the arc periphery begins, and a signal changing the ripple level alternately between these periods is used to drive the high pressure discharge lamp. It is alternatively possible to use as the boundary between the periods of stability and instability the lowest ripple level enabling arc. straightening. For example, if the lowest ripple level achieving arc straightening is 0.65, and the high pressure discharge lamp is driven with a signal whereby the area exceeding this level is equal to or greater than the area below this level, the discharge lamp can be driven with priority given to arc straightening while continuing to suppress irregular oscillation in the arc periphery.

Figure 11:
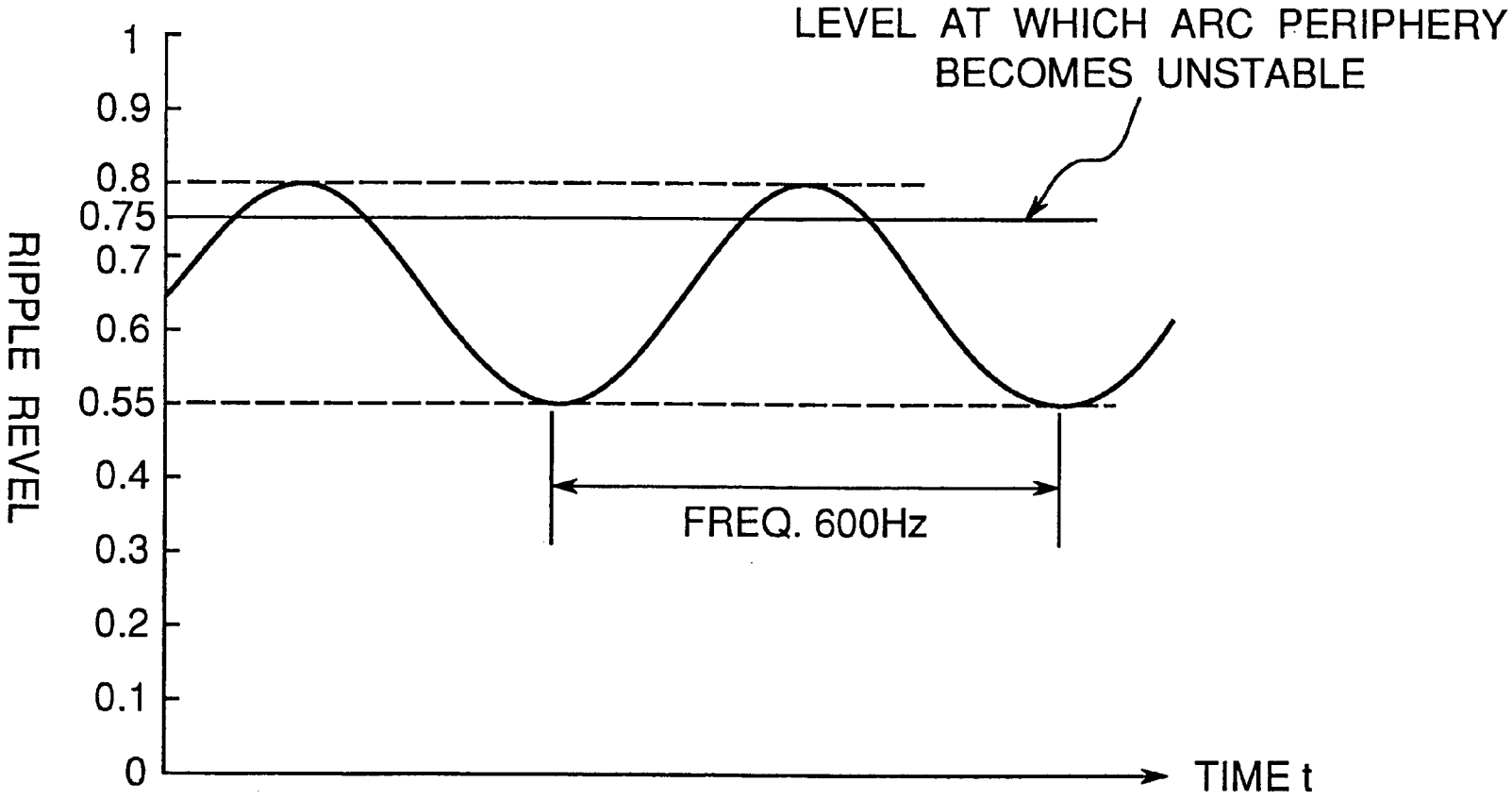
FIG. 11 is a graph used to describe operation when the ripple level is varied over time according to a preferred embodiment of the present invention.

Tests were conducted using a 30.2-kHz high frequency ripple signal r with the ripple level of a sine wave signal varying betweoen approximately 0.55 to approximately 0.80 at 600 Hz. The results are shown in FIG. 11. Note that there was no oscillation in the arc periphery and the arc was straightened as much as possible even when the ripple level exceeded the 0.75 level at which the arc periphery becomes unstable.

Other tests were conducted to test the relationship between maximum and minimum ripple level limits and effectiveness with straightening the discharge arc and suppressing irregular oscillation in the arc periphery. When the maximum ripple level was fixed at 0.75 and the lower limit was pushed below 0.55, discharge arc straightening was less efficient but oscillation suppression improved. When the lower limit was fixed at 0.55and the maximum ripple level was pushed above 0.75, there was no noticeable change in discharge arc straightening and oscillation in the arc periphery increased. It was therefore concluded that the lower limit of the temporally changing ripple level is preferably approximately 0.55, and the upper limit is preferably approximately 0.75.

It should be noted that instability in the arc periphery was dramatically suppressed when the upper limit was set at or below 0.75and the lower limit was at or below 0.55, but discharge arc straightening was weakened.

Figure 15:
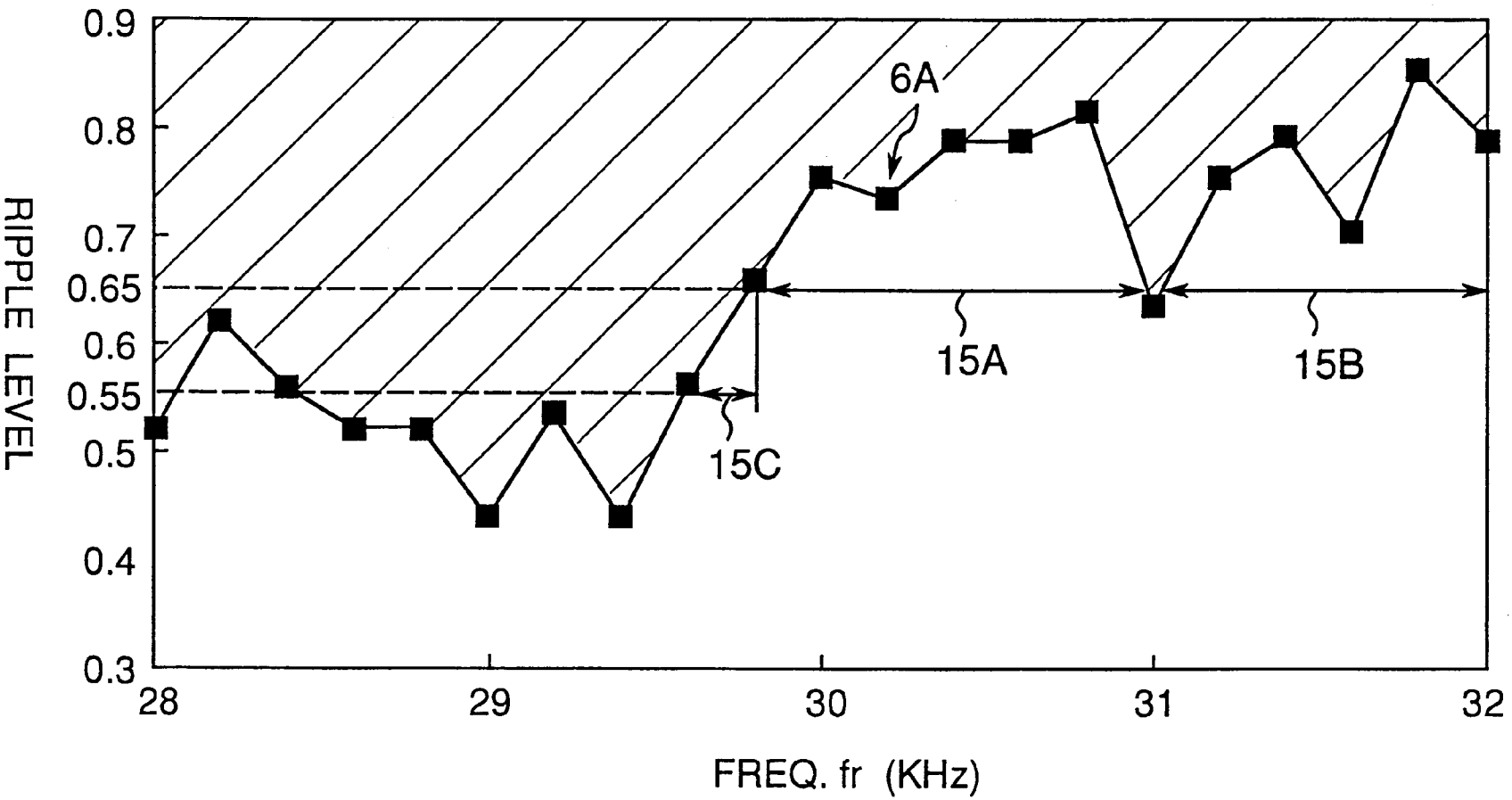
FIG. 15 is a graph used to describe expanding the frequency range in which a stable arc is achieved by means of a preferred embodiment of the present invention.

A method for changing the ripple level over time to a sine wave or triangular wave also has an effect of increasing the stable energizing frequency range. Referring to FIG. 15, for example, the frequency range through which the high pressure discharge lamp can be stably operated with the ripple level held constant at 0.65 is the range indicated by areas 15A and 15B. However, if the ripple level is varied between 0.55 and 0.65, the frequency range expands to include area 15C.

Figure 5:
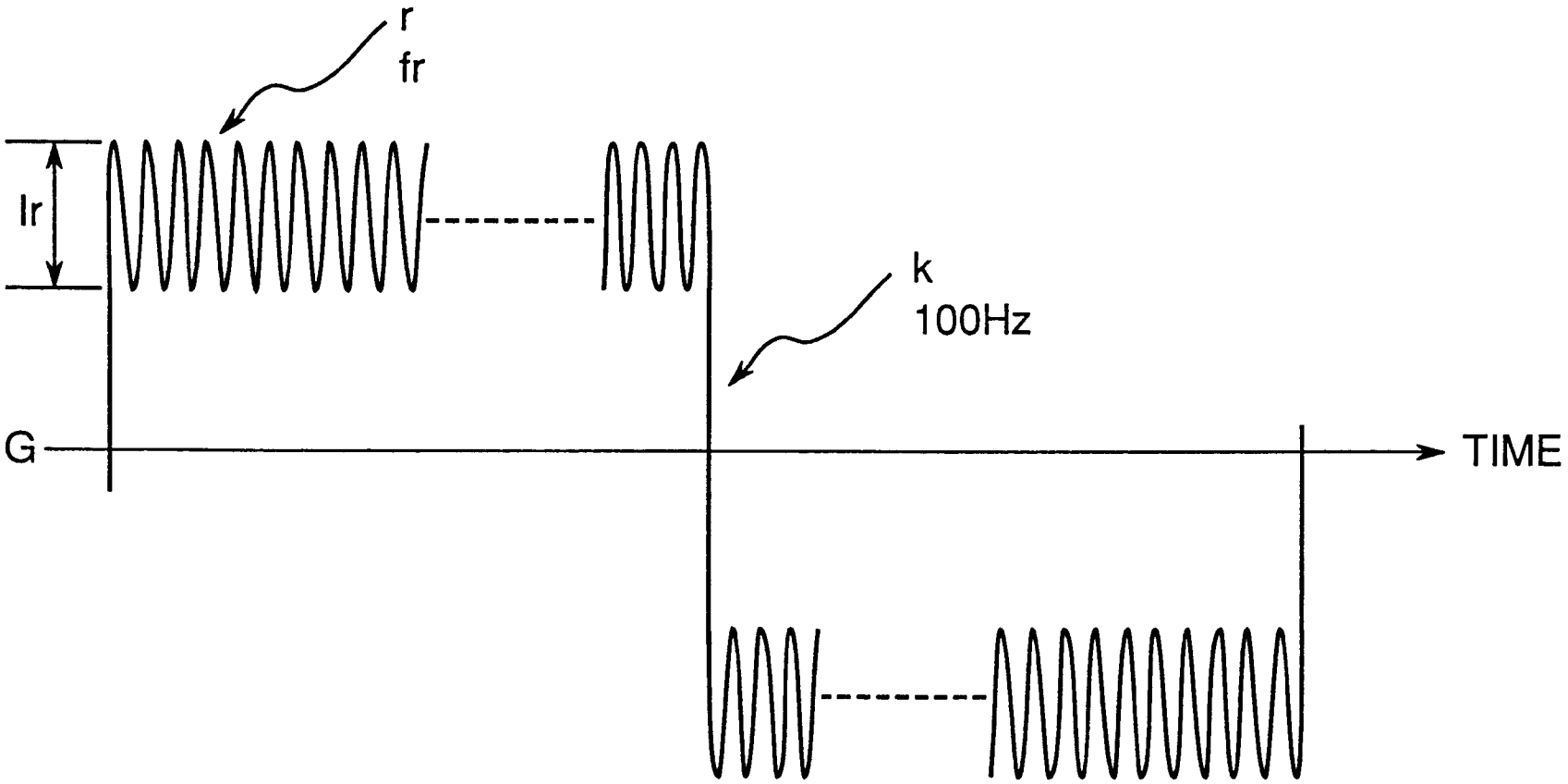
FIG. 5 is a waveform diagram of the lamp current when a high pressure discharge lamp is operated by a rectangular wave current to which a conventional high frequency ripple signal is superposed.

The time-based change in the ripple level can also cross zero as shown in FIG. 5, resulting in an ac signal.

Figure 12A:
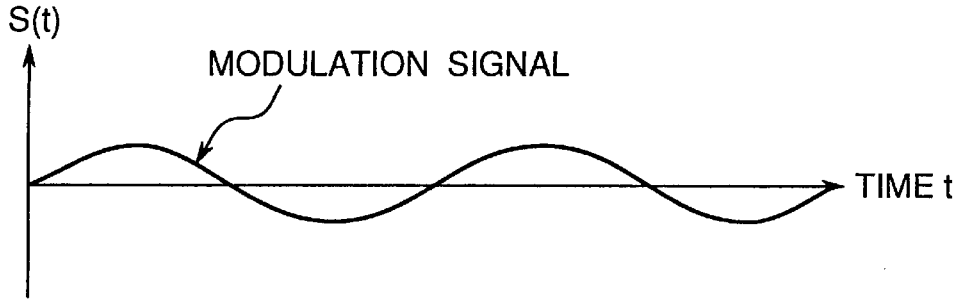
FIGS. 12A, 12B and 12C are graphs used to describe an amplitude-modulated high frequency ripple signal according to a preferred embodiment of the present invention.
Figure 12B:
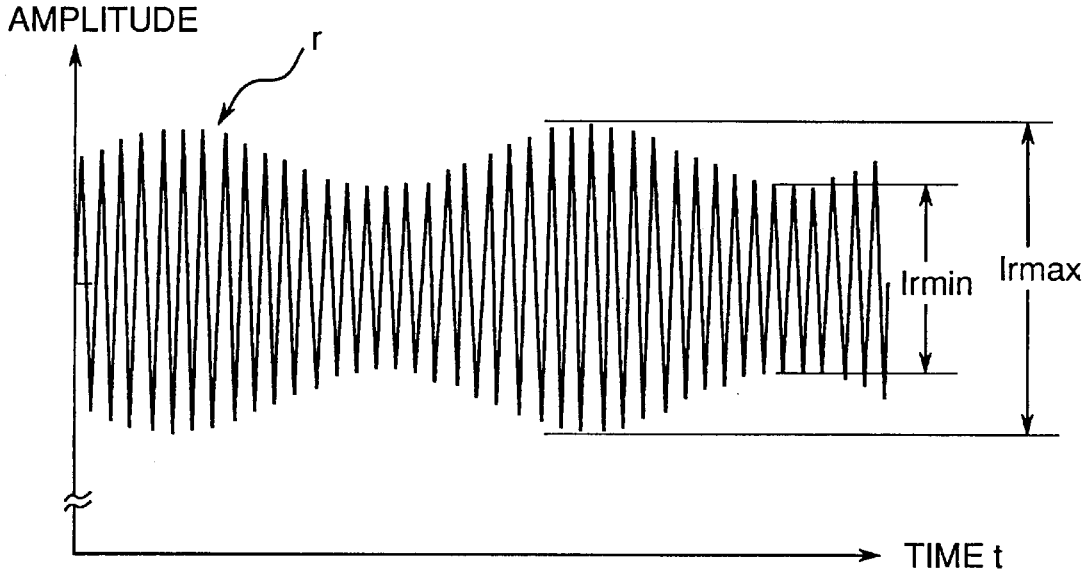
Figure 12C:
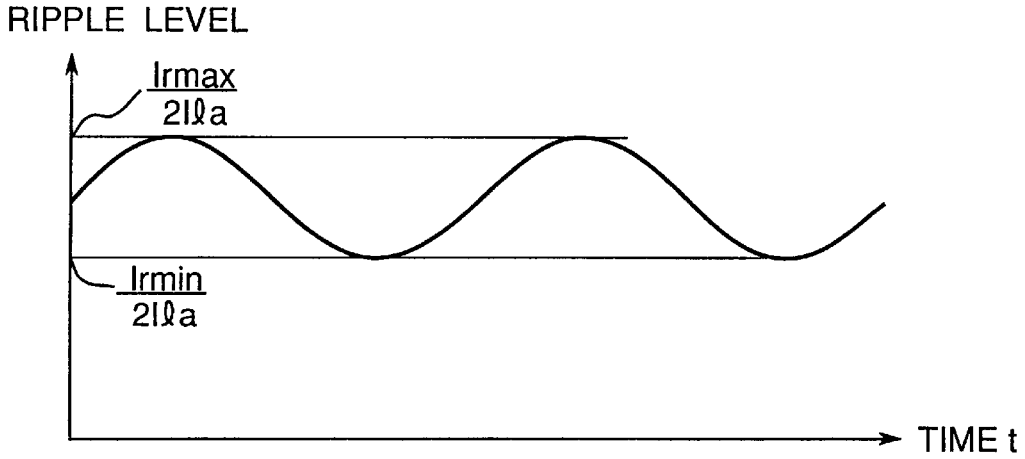
Figure 13:
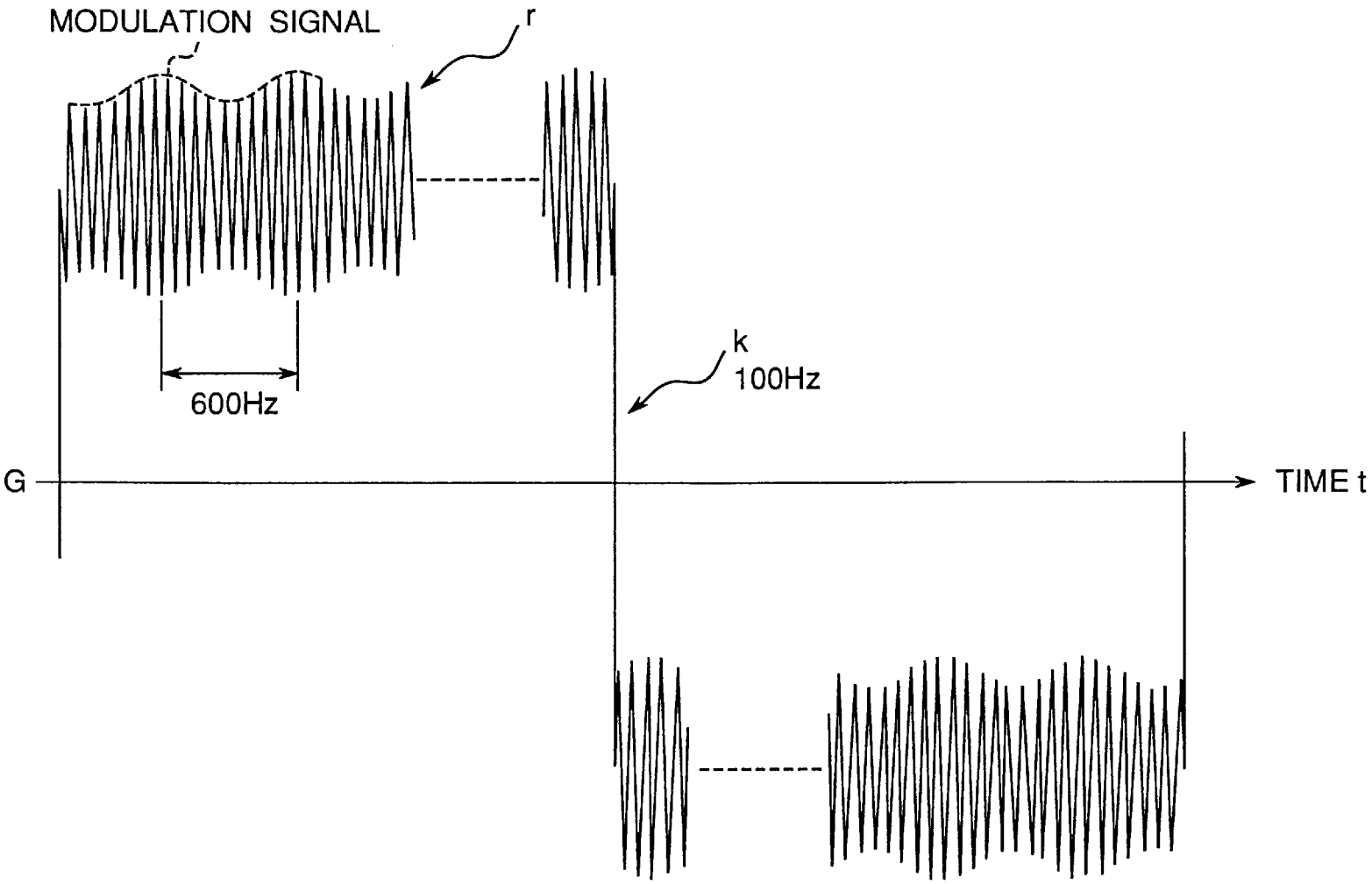
FIG. 13 is a graph to describe a rectangular wave lamp current having a superposed amplitude-modulated high frequency ripple signal according to a preferred embodiment of the present invention.

When the amplitude Ir of the high frequency ripple signal r is modulated using a 600-Hz sine wave modulation signal s(t) (FIG. 12A), the ripple level (FIG. 12C) of the amplitude-modulated high frequency ripple signal r (FIG. 12B) varies in a sine wave pattern between minimum (Irmin/2l1*a*) and maximum (Irmax/2l1*a*) levels where Irmax is the maximum amplitude of the high frequency ripple signal r after amplitude modulation, Irmin is the minimum amplitude of the high frequency ripple signal r after amplitude modulation, and 1*a* is the effective value of the lamp current. FIG. 13 shows the lamp current waveform obtained by superposing on a 100-Hz rectangular wave current k a 30.2-kHz high frequency ripple signal r amplitude modulated by a 600-Hz modulation signal s(t).

The operating method for suppressing instability (irregular oscillation) in the arc periphery as described above is particularly effective with high pressure discharge lamps containing indium iodide (Inl), holmium iodide ($HoI_3$), rare earth elements such as terbium (Tb), dysprosium (Dy), holmium (Ho), erbium (Er), and thulium (Tm), and halides containing these elements. This is because these metal halides have rich light emission characteristics in the visible spectrum even in the low temperature arc periphery as a result of molecular emission of the halogen compound, and even slight instability of the arc periphery is perceived as a significant change in light output.

While the frequency of the rectangular wave k is set to 100 Hz above, it can be varied up to the frequency of the high frequency ripple signal r. However, flicker produced by alternating lamp current polarity occurs when the rectangular wave frequency is below 50 Hz, and audible noise occurs in the range from 1 kHz to 15 kHz. As a result, the preferred range for the frequency of the rectangular wave k is from 50 Hz to 1 kHz.

Figure 16:
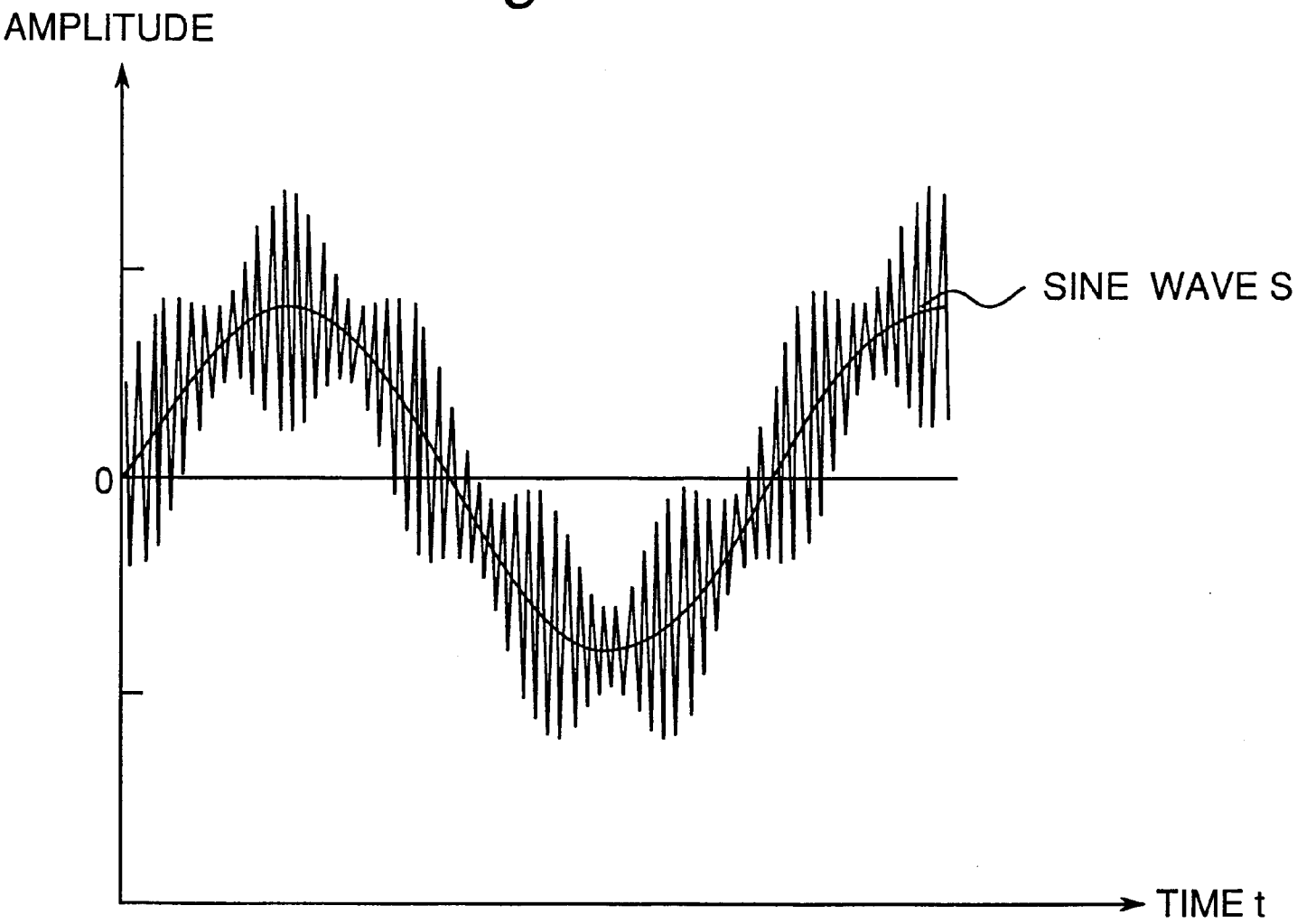
FIG. 16 is a graph used to describe a lamp current waveform having a superposed amplitude-modulated high frequency ripple signal according to an alternative embodiment of the present invention.
Figure 17:
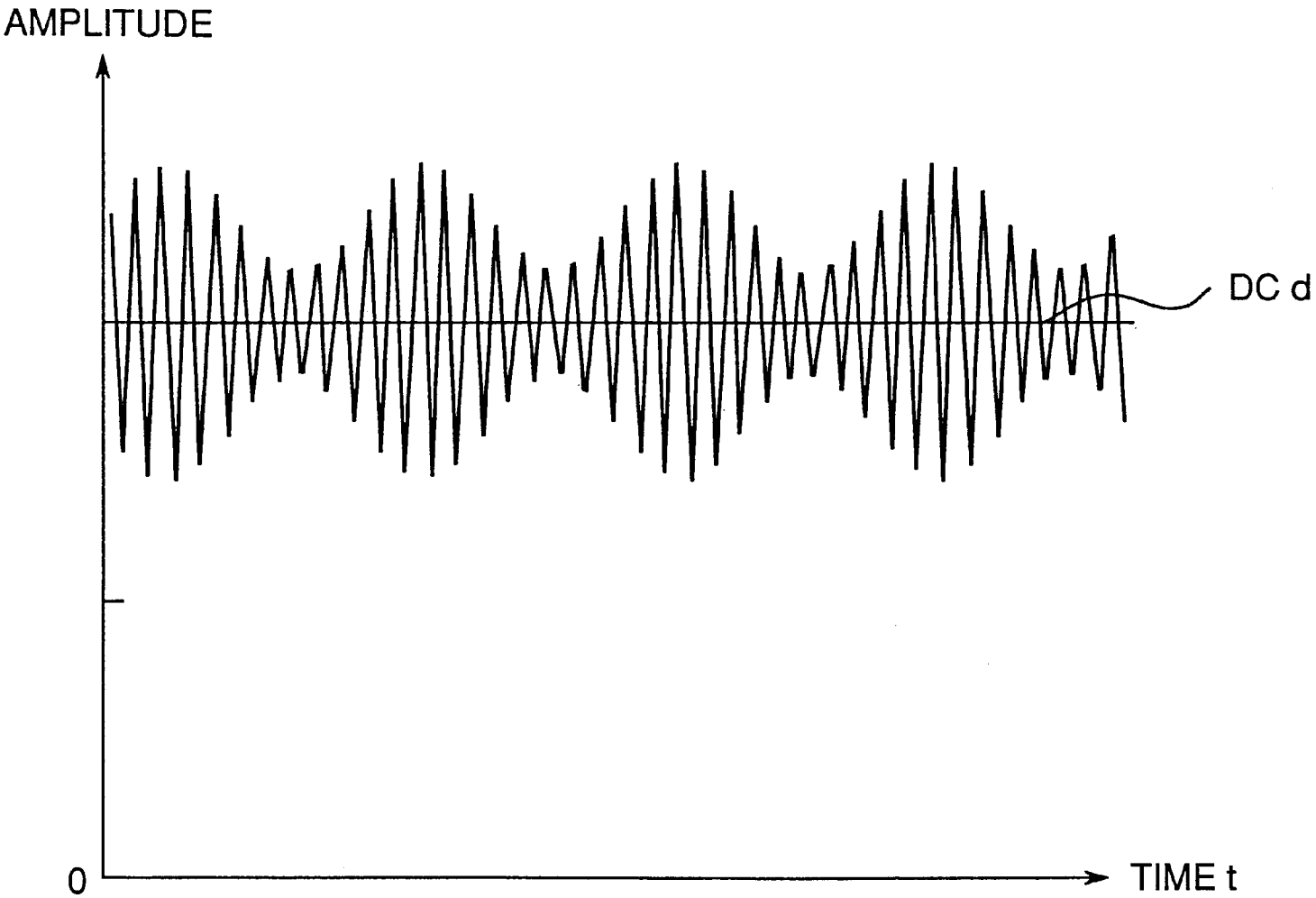
FIG. 17 is a graph used to describe a lamp current waveform having a superposed amplitude-modulated high frequency ripple signal according to a further alternative embodiment of the present invention.

The waveform to which the amplitude-modulated high frequency ripple signal r is superposed shall not be limited to a square wave. More specifically, an amplitude-modulated high frequency ripple signal r can be superposed to a sine wave current s as shown in FIG. 16. An amplitude-modulated high frequency ripple signal r can also be superposed to a current d as shown in FIG. 17.

It will also be obvious that while the preferable range of ripple level change is from 0.55 to 0.75 as described above, the invention shall not be so limited. More specifically, the desirable range of ripple level change will necessarily vary according to such factors as the lamp filler, and lamps comprised differently from that described above shall not be limited to the above described range. For example, a 35-W metal halide lamp containing mercury and iodides of scandium (Sc) and sodium (Na) exhibit discharge arc oscillation in the arc periphery at a ripple level of approximately 0.8 or greater, and a perfectly straight arc at a ripple level of approximately 0.45. The preferable ripple level range in this case is therefore from approximately 0.30 to approximately 0.60.

The operating method of the present invention for achieving a straight arc and suppressing discharge arc instability can be applied with all high pressure discharge lamps.

A unique case is when the ripple level achieving a straight arc is sufficiently less than the ripple level at which the arc periphery becomes unstable. In this case it is apparent that the range is which the arc periphery is stable can be selected as the range of allowable ripple level change, i.e., the upper limit of the ripple level range is set below the ripple level resulting in arc instability.

Related to this, if the ripple level is set such that the high pressure discharge lamp is driven at a ripple level inducing instability in the arc periphery (instability period 10A, FIG. 10)) longer than it is driven at a ripple level not inducing such instability (stability period 10B, FIG. 10), and the arc can be straightened, modulation signal s(t) does not need to be mathematically expressible as a periodic function (such as a sine wave function).

Moreover, the frequency of modulation signal s(t) is described in the exemplary embodiment of the present invention above as being 600 Hz, but is variable to a maximum frequency equal to the frequency of the high frequency ripple signal r. However, audible noise occurs in the range from 1 kHz to 15 kHz; this frequency range is also preferably avoided for practical use. The lower limit is 50 Hz. Flicker also occurs when the frequency is below 50 Hz. As a result, the preferred range for the frequency of the modulation signal s(t) is from 50 Hz to 1 kHz.

It should be further noted that the frequency of the high frequency ripple signal can be outside the range exciting an acoustic resonance mode (a frequency effective for reducing discharge arc curvature caused by convection).

The invention being thus described, it is apparent that the same may be varied in many ways. Such variations are not tq be regarded as a departure from the spirit and scope of the invention, and all such modifications as would be obvious to one skilled in the art are intended to be included within the scope of the following claims.

What is claimed is:

1. An operating method for operating a high pressure discharge lamp by applying a discharge current between two electrodes so as to generate an arc having an arc periphery, where the discharge lamp includes the two electrodes disposed with a discharge gap therebetween inside a transparent envelope, and the envelope having a substantially symmetrical shape and being sealed with a noble gas or a noble gas compound, and a filler containing one or a plurality of metal halides, contained therein, said operating method comprising:

generating a high frequency ripple signal of a first frequency;

amplitude modulating the high frequency ripple signal by a modulation signal of a second frequency in a range from 50 Hz to 1 kHz that is lower than the first frequency, to obtain an amplitude-modulated high frequency ripple signal having a ripple level that alternates periodically between a stability period, during which the arc periphery is stable, and an instability period, during which the arc periphery is unstable and oscillation in the arc periphery tends to start, wherein the instability period is shorter than the stability period; and operating the high pressure discharge lamp by applying the discharge current to both ends of the discharge gap by the amplitude-modulated high frequency ripple signal.

2. An operating method for operating a high pressure discharge lamp by applying a discharge current between two electrodes so as to generate an arc having an arc periphery, where the discharge lamp includes the two electrodes disposed with a discharge gap therebetween inside a transparent envelope, and the envelope having a substantially symmetrical shape and being sealed with a noble gas or a noble gas compound, and a filler containing one or a plurality of metal halides, contained therein, said operating method comprising:

generating a high frequency ripple signal of a first frequency;

amplitude modulating the high frequency ripple signal by a modulation signal of a second frequency that is lower than the first frequency, to obtain an amplitude-modulated high frequency ripple signal having a ripple level that alternates periodically between a stability period, during which the arc periphery is stable, and an instability period, during which the arc periphery is unstable and oscillation in the arc periphery tends to start, wherein the instability period is shorter than the stability period;

operating the high pressure discharge lamp by applying the discharge current to both ends of the discharge gap by the amplitude-modulated high frequency ripple signal; and alternating the polarity of the amplitude-modulated high frequency ripple signal by an ac signal alternating at a third frequency that is lower than the second frequency.

3. An operating apparatus for operating a high pressure discharge lamp by applying a discharge current between two electrodes so as to generate an arc having an arc periphery, where the discharge lamp includes the two electrodes disposed with a discharge gap therebetween inside a transparent envelope, and the envelope having a substantially symmetrical shape and being sealed with a noble gas or a noble gas compound, and a filler containing one or a plurality of metal halides, contained therein, said operating apparatus comprising:

a generator which generates a high frequency ripple signal of a first frequency;

an amplitude modulator operable to modulate the high frequency ripple signal by a modulation signal of a second frequency in a range from 50 Hz to 1 kHz that is lower than the first frequency, to obtain an amplitude-modulated high frequency ripple signal having a ripple level that alternates periodically between a stability period, during which the arc periphery is stable, and an instability period, during which the arc periphery is unstable and oscillation in the arc periphery tends to start, wherein the instability period is shorter than the stability period; and an operating circuit operable to drive the high pressure discharge lamp by applying the discharge current to both ends of the discharge gap by the amplitude-modulated high frequency ripple signal.

4. An operating apparatus for operating a high pressure discharge lamp by applying a discharge current between two electrodes so as to generate an arc having an arc periphery, where the discharge lamp includes the two electrodes disposed with a discharge gap therebetween inside a transparent envelope, and the envelope having a substantially symmetrical shape and being sealed with a noble gas or a noble gas compound, and a filler containing one or a plurality of metal halides, contained therein, said operating apparatus comprising:

a generator operable to generate a high frequency ripple signal of a first frequency;

an amplitude modulator operable to modulate the high frequency ripple signal by a modulation signal of a second frequency that is lower than the first frequency, to obtain an amplitude-modulated high frequency ripple signal having a ripple level that alternates periodically between a stability period, during which the arc periphery is stable, and an instability period, during which the arc periphery is unstable and oscillation in the arc periphery tends to start, wherein the instability period is shorter than the stability period;

an operating circuit operable to drive the high pressure discharge lamp by applying the discharge current to both ends of the discharge gap by the amplitude-modulated high frequency ripple signal; and an alternator operable to alternate the polarity of the amplitude-modulated high frequency ripple signal by an ac signal alternating at a third frequency that is lower than the second frequency.

5. The operating method for a high pressure discharge lamp according to claim 1, further comprising:

alternating the polarity of the amplitude-modulated high frequency ripple signal by an ac signal alternating at a third frequency that is lower than the second frequency.

6. The operating method for a high pressure discharge lamp according to claim 1, wherein the maximum ripple level of the amplitude-modulated high frequency ripple signal is within the discharge arc instability range in which irregular oscillation in the arc periphery occurs.

7. The operating method for a high pressure discharge lamp according to claim 1, wherein the minimum ripple level of the amplitude-modulated high frequency ripple signal is set outside the discharge arc instability range in which irregular oscillation in the arc periphery occurs.

8. The operating method for a high pressure discharge lamp according to claim 5, wherein the ac signal is a rectangular wave signal.

9. The operating method for a high pressure discharge lamp according to claim 5, wherein the third frequency is in the range from 50 Hz to 1 kHz.

10. The operating method for a high pressure discharge lamp according to claim 1, wherein the modulation signal is a sine wave, triangular wave, sawtooth wave, rectangular wave, exponential function wave, or composite wave.

11. The operating method for a high pressure discharge lamp according to claim 2, wherein the second frequency is in the range from 50 Hz to 1 kHz.

12. The operating method for a high pressure discharge lamp according to claim 1, wherein the first frequency is a frequency exciting acoustic resonance having the effect of reducing discharge arc curvature caused by convection inside the transparent envelope.

13. The operating method for a high pressure discharge lamp according to claim 12, wherein the high frequency ripple signal is amplitude modulated by a modulation signal such that the maximum amplitude of the high frequency ripple signal is 1.5×Irms (peak-to-peak) and the minimum amplitude is 1.1×Irms (peak-to-peak), where Irms is the effective value of the discharge current.

14. The operating method for a high pressure discharge lamp according to claim 1, wherein a metal halide capable of emitting light in the low temperature discharge arc area is sealed inside the transparent envelope.

15. The operating method for a high pressure discharge lamp according to claim 14, wherein the metal halide is one of the following rare earth elements or a compound thereof: terbium (Tb), dysprosium (Dy), holmium (Ho), erbium (Er), and thulium (Tm).

16. The operating apparatus for a high pressure discharge lamp according to claim 3, wherein said generator comprises a switch element, and wherein said amplitude modulator comprises a filter circuit including a capacitor and an inductor.

17. The operating apparatus for a high pressure discharge lamp according to claim 3, further comprising an alternator which alternates the polarity of the amplitude-modulated high frequency ripple signal by an ac signal alternating at a third frequency that is lower than the second frequency.

18. The operating apparatus for a high pressure discharge lamp according to claim 3, further comprising a pulse transformer having a second winding connected in series to the high pressure discharge lamp for facilitating starting the high pressure discharge lamp.

19. The operating apparatus for a high pressure discharge lamp according to claim 16, wherein said amplitude modulator comprises, a modulation signal generation circuit, and a control circuit for varying the on-off frequency of said switch element at a speed equal to the reciprocal of the second frequency and proportional to the amplitude of the modulation signal.

20. The operating apparatus for a high pressure discharge lamp according to claim 3, wherein said amplitude modulator comprises a modulation signal generation circuit, and a variable resistance element of which the resistance changes at a speed equal to the reciprocal of the second frequency and proportional to the amplitude of the modulation signal.

21. The operating apparatus for a high pressure discharge lamp according to claim 16, wherein the on-off switching frequency of said switch element is a frequency exciting acoustic resonance having the effect of reducing discharge arc curvature caused by convection inside the transparent envelope.

22. An operating apparatus for operating a high pressure discharge lamp according to claim 4 wherein the second frequency is in the range from 50 Hz to 1 kHz.

23. The operating method according to claim 1, wherein said amplitude modulating of the high frequency ripple signal is such that the ripple level of the amplitude-modulated high frequency ripple signal is periodically changed between an upper limit of 0.60–0.80 and a lower limit of 0.30–0.55.

24. The operating method according to claim 2, wherein said amplitude modulating of the high frequency ripple signal is such that the ripple level of the amplitude-modulated high frequency ripple signal is periodically changed between an upper limit of 0.60–0.80 and a lower limit of 0.30–0.55.

25. The operating apparatus according to claim 3, wherein said amplitude modulator is operable to modulate the high frequency ripple signal such that the ripple level of the amplitude-modulated high frequency ripple signal is periodically changed between an upper limit of 0.60–0.80 and a lower limit of 0.30–0.55.

26. The operating apparatus according to claim 4, wherein said amplitude modulator is operable to modulate the high frequency ripple signal such that the ripple level of the amplitude-modulated high frequency ripple signal is periodically changed between an upper limit of 0.60–0.80 and a lower limit of 0.30–0.55.

* * * * *